US010719046B2

(12) United States Patent
Kanamoto

(10) Patent No.: US 10,719,046 B2
(45) Date of Patent: Jul. 21, 2020

(54) IMAGE FORMING APPARATUS METHOD FOR CONTROLLING IMAGE FORMING APPARATUS AND STORAGE MEDIUM

(71) Applicant: CANON KABUSHIKI KAISHA, Tokyo (JP)

(72) Inventor: Yoshiji Kanamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/389,071

(22) Filed: Apr. 19, 2019

(65) Prior Publication Data

US 2019/0243297 A1 Aug. 8, 2019

Related U.S. Application Data

(63) Continuation of application No. 15/785,152, filed on Oct. 16, 2017, now Pat. No. 10,303,105, which is a continuation of application No. 14/976,600, filed on Dec. 21, 2015, now Pat. No. 9,817,355.

(30) Foreign Application Priority Data

Dec. 25, 2014 (JP) ..... 2014-263183

(51) Int. Cl.
*G03G 15/00* (2006.01)

(52) U.S. Cl.
CPC ..... *G03G 15/6544* (2013.01); *G03G 15/6508* (2013.01)

(58) Field of Classification Search
CPC ..... G03G 15/6508
USPC ..... 399/410
See application file for complete search history.

(56) References Cited

U.S. PATENT DOCUMENTS 5,073,803 A * 12/1991 Kato ..... G03G 15/50 270/37
5,823,529 A * 10/1998 Mandel ..... B65H 39/11 271/296
2004/0183246 A1* 9/2004 Jung ..... B42C 1/12 270/37
2007/0201071 A1* 8/2007 Yamada ..... G06F 3/1205 358/1.13
2008/0181699 A1* 7/2008 Ueda ..... G03G 15/6582 399/408
2009/0129892 A1* 5/2009 Okada ..... B42B 5/103 412/11
2013/0214477 A1* 8/2013 Kamata ..... B65H 7/20 271/9.05
2014/0003885 A1* 1/2014 Mutsuno ..... B42B 4/00 412/6
2014/0154032 A1* 6/2014 Mizuno ..... B42B 5/00 412/6
2015/0076759 A1* 3/2015 Kosuge ..... B65H 31/34 270/1.01

* cited by examiner

*Primary Examiner* — Anthony H Nguyen
(74) *Attorney, Agent, or Firm* — Canon U.S.A., Inc. IP Division

(57) ABSTRACT

An MFP that accepts instructions to execute jobs includes, and takes holding units that hold sheets that can be subjected to binding processing specified by a job, where the holding units are considered search targets in an automatic selection process. The MFP performs auto paper selection on the holding units as the search targets, and if there is a candidate holding unit, feeds sheets to be used for printing from the holding unit and performs printing.

22 Claims, 15 Drawing Sheets

FIG.11

| SHEET TYPE | GRAMMAGE [g/m$^2$] | SURFACE PROPERTY | TWO-SIDED PRINTING | STAPLE BINDING PROCESSING (1111) | | STAPLELESS BINDING PROCESSING (1113) | ..... |
|---|---|---|---|---|---|---|---|
| | | | | CORNER BINDING (1111) | DOUBLE BINDING (1112) | | |
| PLAIN PAPER 1 | 80~90 | HIGH QUALITY PAPER | ○ | ○ | ○ | ○ | ..... |
| THIN PAPER 1 | 52~63 | HIGH QUALITY PAPER | ○ | ○ | ○ | ○ | ..... |
| THICK PAPER 1 | 110~160 | HIGH QUALITY PAPER | ○ | ○ | ○ | × | ..... |
| THICK PAPER 2 | 161~256 | HIGH QUALITY PAPER | × | ○ | ○ | × | ..... |
| LABEL PAPER | 118~185 | LABEL PAPER | × | × | × | × | ..... |
| ⋮ | ⋮ | ⋮ | ⋮ | ⋮ | ⋮ | ⋮ | ⋱ |

IMAGE FORMING APPARATUS METHOD FOR CONTROLLING IMAGE FORMING APPARATUS AND STORAGE MEDIUM

CROSS-REFERENCE TO RELATED APPLICATIONS

This application is a continuation of U.S. patent application Ser. No. 15/785,152 filed Oct. 16, 2017, which is a continuation and claims the benefit of U.S. application Ser. No. 14/976,600 filed Dec. 21, 2015 (now U.S. Pat. No. 9,817,355), which claims the benefit of Japanese Patent Application No. 2014-263183 filed Dec. 25, 2014, all of which are hereby incorporated by reference herein in their entirety.

BACKGROUND

Field

Aspects of the present invention generally relate to an image forming apparatus that executes a print job in which binding processing is set.

Description of the Related Art

Binding processing for aligning and binding a plurality of printed sheets is conventionally known as one of post-processing functions executable by an image forming apparatus.

As a method for binding sheets, conventionally, an image forming apparatus includes a binding unit that binds a bundle of a plurality of sheets by using a binding material such as a staple. There is also an image forming apparatus including a binding unit that binds sheets without using the binding material such as a staple (for example, Japanese Patent Application Laid-Open Nos. 2010-189101 and 2012-025499). The image forming apparatus discussed in Japanese Patent Application Laid-Open No. 2010-189101 includes a binding unit that pinches and presses a sheet bundle between teeth forms to entangle fibers of the sheets to bind the sheet bundle without using the binding material, such as a staple, in consideration of an environment-friendliness. Further, the image forming apparatus discussed in Japanese Patent Application Laid-Open No. 2012-025499 includes a binding unit that forms a tongue-shaped piece and a slit hole in a sheet bundle, and inserts the tongue-shaped piece into the slit hole to bind the sheet bundle.

Furthermore, an image forming apparatus including a plurality of holding units (for example, sheet cassettes) for holding sheets and having a function of automatically selecting a holding unit to be used for printing based on a sheet size from among the plurality of holding units is conventionally known (for example, Japanese Patent Application Laid-Open No. 10-240078).

An image forming apparatus may include a plurality of binding units. For example, an image forming apparatus may include both a binding unit for binding a sheet bundle by using the binding material and a binding unit for binding a sheet bundle without using the binding material.

As compared to the binding unit for binding the sheet bundle by using the binding material, the binding unit for binding the sheet bundle without using the binding material is characteristically more susceptible to the surface properties and grammage of the sheets to bundle, and can bind only fewer sheet types.

If such an image forming apparatus including binding units for performing different types of binding processing is configured to select a holding unit using a shared method regardless of the type of the binding processing, the following issue occurs. If many types of sheets are subjected to the selection, a holding unit holding sheets of a type which cannot be bound through stapleless binding processing may be selected although the stapleless binding processing is specified. In such a case, even if the user expects a properly-bound print product, sheets of the type which cannot be bound can be fed and thus output without undergoing the binding processing.

The foregoing issue does not occur if the types of sheets to be selected are limited to those which can be bound through the stapleless binding processing. This, however, may cause an issue that selectable holding units decrease in a case where a sheet bundle is output without binding or where a sheet bundle is output through the staple binding processing.

SUMMARY

Aspects of the present invention are directed to enabling appropriate selection of a holding unit according to a specified binding processing type when selecting a holding unit to be used based on a sheet size from among a plurality of holding units holding sheets.

According to an aspect of the present invention, an image forming apparatus includes a plurality of holding units configured to hold a sheet, an execution unit configured to execute a job for printing an image on a plurality of sheets, a selection unit configured to select a holding unit as a feeding source of a sheet to be used for printing from among the plurality of holding units based on a size of the image to be printed on the sheet by the execution unit executing the job, a printing unit configured to print the image on the sheet fed from the holding unit selected by the selection unit, a binding unit configured to bind the sheet on which the image is printed, and a control unit configured to, in a case where a sheet is set to be bound by the binding unit, not permit a holding unit which holds a predetermined type of sheet, to be selected by the selection unit, and in a case where a sheet is not set to be bound by the binding unit, permit the holding unit which holds the predetermined type of sheet, to be selected by the selection unit.

Further features of the present disclosure will become apparent from the following description of exemplary embodiments with reference to the attached drawings.

BRIEF DESCRIPTION OF THE DRAWINGS

FIG. 11 is a diagram illustrating a data model of a sheet information database.

DESCRIPTION OF THE EMBODIMENTS

Exemplary embodiments of aspects of the present invention will be described in detail below with reference to the drawings. It should be noted that the following exemplary embodiments are not intended to limit the aspects of the invention set forth in the claims, and all combinations of features described in the exemplary embodiments are not necessarily indispensable to the solving means of the aspects of the invention.

Figure 1:
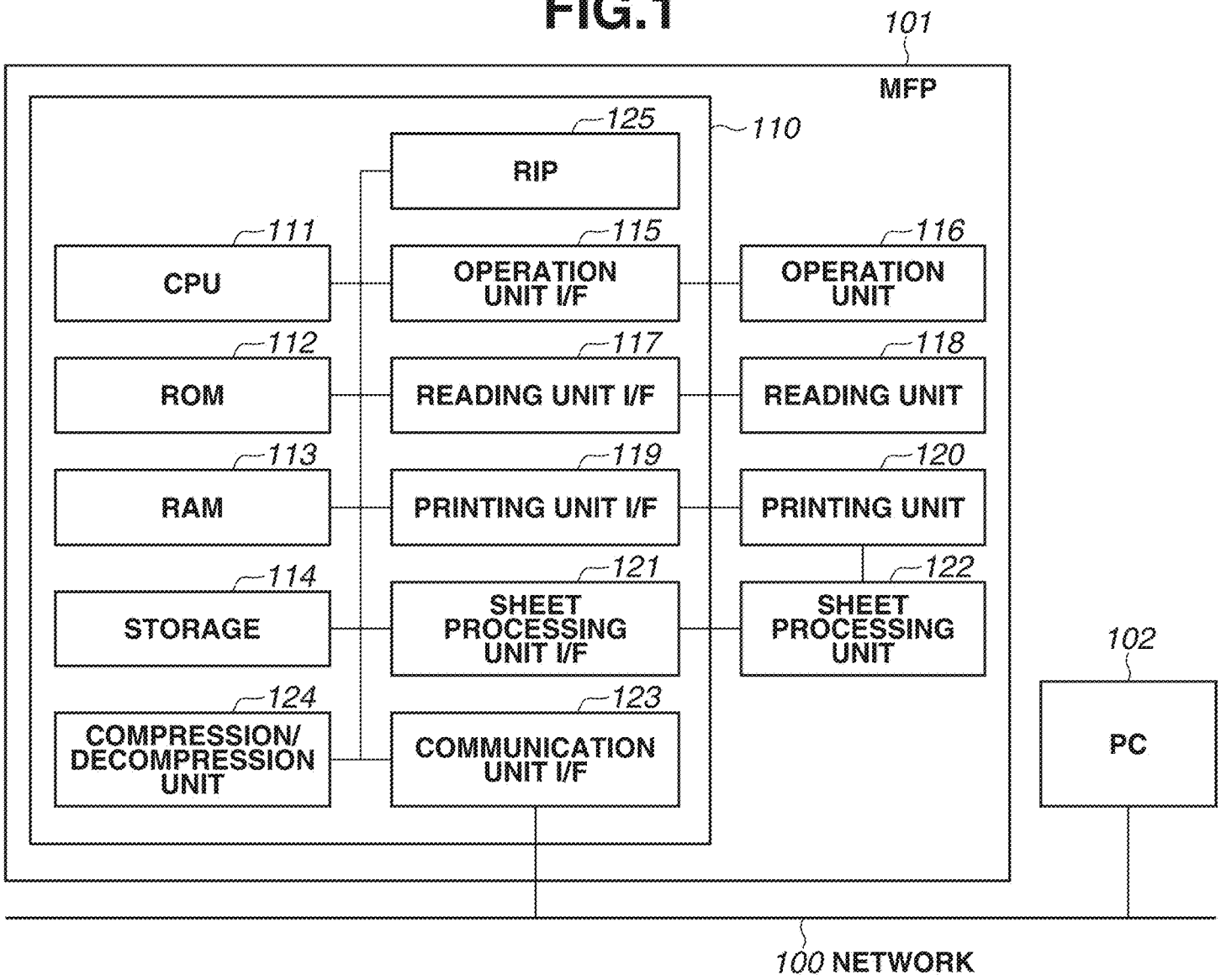
FIG. 1 is a block diagram illustrating a print processing system.

A first exemplary embodiment will now be described. FIG. 1 is a block diagram illustrating a print processing system according to the present exemplary embodiment. In the present exemplary embodiment, a multifunction peripheral (MFP) 101 will be described as an example of an image forming apparatus. A personal computer (PC) 102 will be described as an example of an information processing apparatus. The MFP 101 and the PC 102 are communicably connected via a network 100.

FIG. 1 illustrates a case where the print processing system includes one information processing apparatus. However, the MFP 101 and a plurality of information processing apparatuses may be communicably connected via the network 100. The print processing system according to the present exemplary embodiment includes the MFP 101 and the PC 102. However, the exemplary embodiment is not limited thereto. For example, singly the MFP 101 may be referred to as a print processing system.

The PC 102 will be described. The PC 102 can execute various programs, for example, application programs. A printer driver having a function of converting printing contents into print data to be transmitted to the MFP 101 is installed in the PC 102. A user who wants to perform printing can make a print instruction from various applications. Based on the print instruction, the printer driver can convert data output from the application into print data interpretable by the MFP 101, and transmit the print data to the MFP 101 connected with the network 100.

In the present exemplary embodiment, the PC 102 is described as an example of the information processing apparatus. However, the information processing apparatus may be a portable information terminal such as a smartphone and a tablet terminal. Appropriate modifications may be made to the method for transmitting print data to the image forming apparatus. Print data may be transmitted to the image forming apparatus via a printing application or driver. Alternatively, print data may be transmitted to the image forming apparatus via a cloud server.

Next, the MFP 101 will be described. The MFP 101 has a reading function of reading an image on a sheet, and a printing function of printing an image on a sheet. The MFP 101 also has a post-processing function of binding a plurality of sheets on which images are printed, and aligning a plurality of sheets.

In the present exemplary embodiment, the MFP 101 is described as an example of the image forming apparatus. However, the image forming apparatus may be a printer without a reading function. In the present exemplary embodiment, for example, the image forming apparatus includes various constituents features described below.

A control unit 110 including a central processing unit (CPU) 111 controls an operation of the entire MFP 101. The CPU 111 reads a control program stored in a read-only memory (ROM) 112 or a storage 114, and performs various controls such as a read control and a print control. The ROM 112 stores a control program executable by the CPU 111. The RAM 112 also stores a boot sequence and font information. A random access memory (RAM) 113 is a main storage memory of the CPU 111. The RAM 113 is used as a work area and a temporary storage area for loading various control programs stored in the ROM 112 and the storage 114. The storage 114 stores image data, print data, various programs, and various types of setting information. In the present exemplary embodiment, the storage 114 is an auxiliary storage device such as a hard disk drive (HDD). A flash disk typified by a solid state drive (SSD), may be used instead of a HDD.

The MFP 101 according to the present exemplary embodiment is configured such that a single CPU 111 performs processing illustrated in flowcharts as described below, by using a single memory (RAM 113). However, other forms may be taken. For example, a plurality of CPUs, RAMs, ROMs, and storages may perform the processing illustrated in the following flowcharts in a cooperative manner. Further, a hardware circuit such as an application specific integrated circuit (ASIC) and a field programmable gate array (FPGA) may be used to perform part of the processing.

Figure 2:
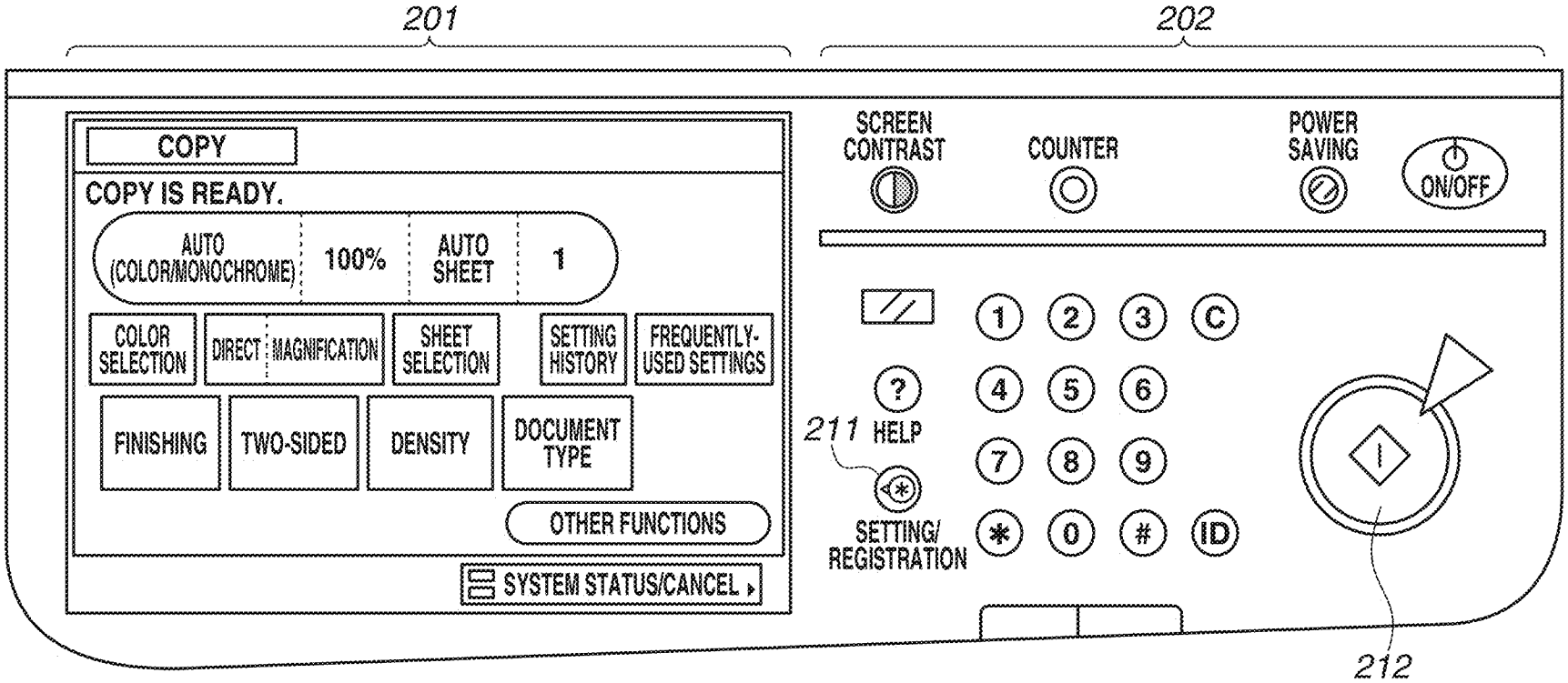
FIG. 2 is a diagram illustrating an operation unit.

An operation unit interface (I/F) 115 connects an operation unit 116 and the control unit 110. The operation unit 116 displays information to the user and receives instructions from the user. FIG. 2 is an external view illustrating the operation unit 116. The operation unit 116 includes a panel 201 which displays operation screens to be described below, and a hardware key input unit 202. An example of the panel 201 is a touch panel display. The hardware key input unit 202 includes various hardware keys such as a setting button 211 and a start button 212. The user inputs instructions by touching keys displayed on the panel 202 or pressing various hardware keys of the hardware key input unit 202. The panel 201 may be a display without a touch panel function. In such a case, instead of the key input made by touch operations, the hardware key input unit 202 may include scroll keys for selecting a key displayed on the display and an enter key for determining the key. The operation unit 116 accepts instructions from the user via the panel 201 and the input unit 202, and displays an operation screen on the panel 201 as needed.

A reading unit I/F 117 connects a reading unit 118 and the control unit 110. The reading unit 118 reads an image on a sheet and converts the image into image data such as binary data. The image data generated by the reading unit 118 is transferred to a compression/decompression unit 124 via the reading unit I/F 117. Image data compressed by the compression/decompression 124 is stored in the storage 114 or the RAM 113 of the control unit 110. The stored image data is transmitted to an external apparatus via a communication unit I/F 123 and/or printed on a sheet.

A printing unit I/F 119 connects a printing unit 120 and the control unit 110. Print target image data (image data to be printed) is transferred from the control unit 110 to the printing unit 120 via the printing unit I/F 119. The printing unit 120 receives a control command and the print target image data via the control unit 110, and prints an image based on the image data onto a sheet.

A sheet processing unit I/F 121 connects a sheet processing unit 122 and the control unit 110. The sheet processing unit 122 receives a control command via the control unit 110, and applies post-processing to a sheet or sheets printed by the printing unit 120 according to the control command. For example, the sheet processing unit 122 performs post-processing such as aligning a plurality of sheets and binding a plurality of sheets. Post-processing functions and post-processing capabilities of the sheet processing unit 120 are notified to the control unit 110 in advance (for example, when the MFP 101 is activated) via the sheet processing unit I/F 121, and notified to the storage 114 or the RAM 113. In the present exemplary embodiment, the sheet processing unit 122 can perform at least binding processing for binding sheets by using a binding material such as a staple (hereinafter, staple binding processing) and binding processing for binding sheets without using the binding material (hereinafter, stapleless binding processing).

The control unit 110 is connected to the network 100 via the communication unit I/F 123. The control unit I/F 123 transmits image data and information to an external apparatus on the network 100, and receives print data and information from the information processing apparatus on the network 100. The communication unit I/F 123 further communicates with an external apparatus via a local interface such as Universal Serial Bus (USB). The print data received by the communication unit I/F 123 is stored in the storage 114.

The print data received via the communication unit I/F 123 is analyzed by a software module for analyzing print data (page description language (PDL) analysis unit, not illustrated) stored in the storage 114 or the ROM 112. The PDL analysis unit analyzes print data expressed in various types of PDLs, stored in the storage 114. Print data includes code related to print attributes and code related to drawing. The PDL analysis unit temporarily stores settings (print attribute information) about the print attributes obtained by the analysis of the print data in the RAM 113 or the storage 114. The PDL analysis unit analyses and converts the drawing code included in the print data into intermediate code.

In addition, the PDL analysis unit calculates the number of sheets to be output from the result of analysis of the PDL, and stores the number of sheets in the RAM 113 or the storage 114 as print attribute information. The print attribute information obtained or calculated by the PDL analysis unit is referred to as appropriate when the print processing based on the print data or the post-processing by the sheet processing unit 122 is performed.

A raster image processor (RIP) 125 converts the intermediate code generated by the PDL analysis unit into image data. The RIP 125 performs rendering processing on the intermediate code generated by the PDL analysis unit to generate image data to be printed by the printing unit 120. The image data generated by the RIP 125 is printed by the printing unit 120 based on print settings.

Figure 3:
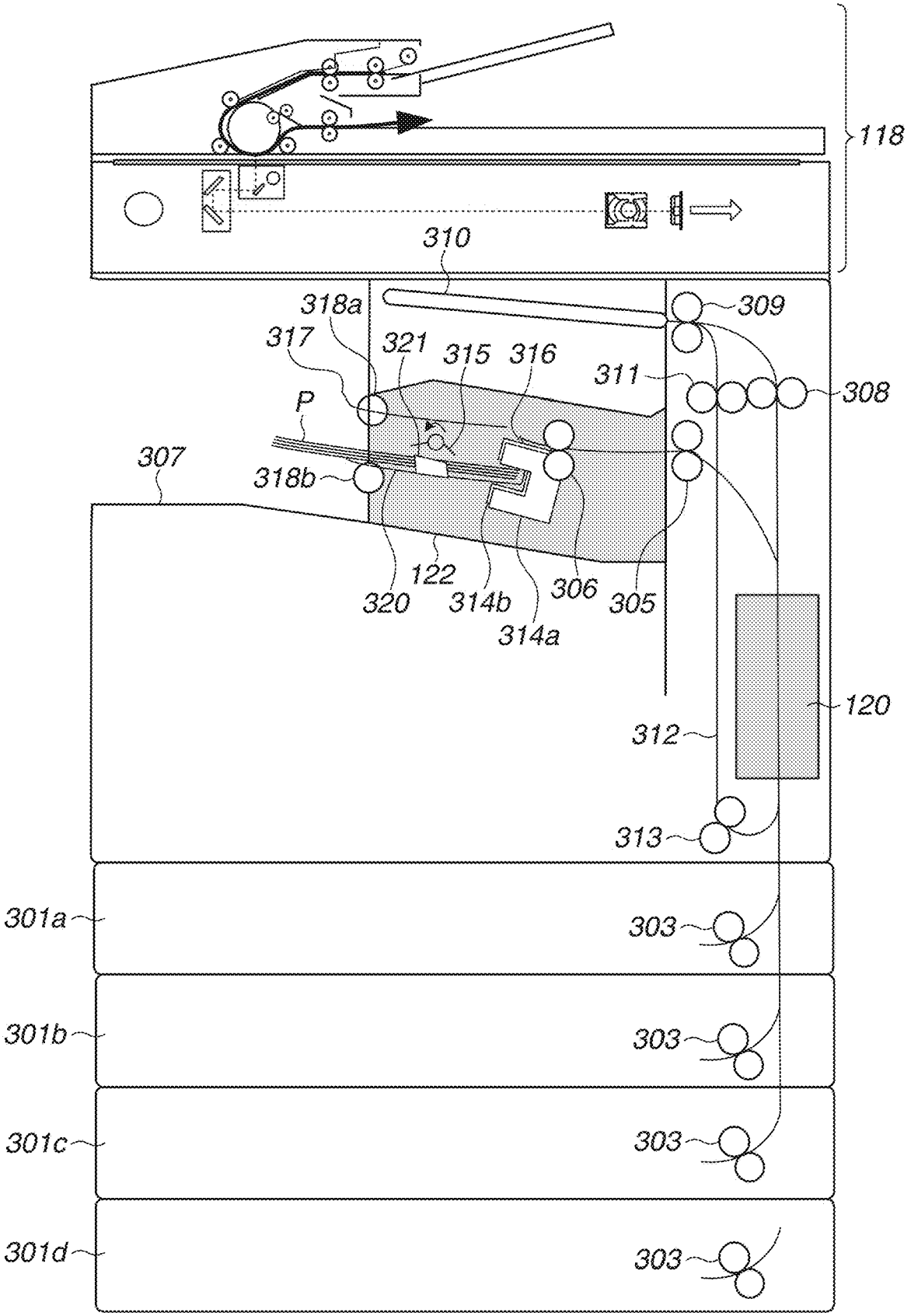
FIG. 3 is a sectional view of a multifunction peripheral (MFP).

Next, the print processing and post-processing on sheets will be described. FIG. 3 is a sectional view of the MFP 101. In FIG. 3, the sheet processing unit 122 is arranged within a casing of the MFP 101. However, the arrangement of the sheet processing unit 122 is not limited to the example of FIG. 3. For example, the sheet processing unit 122 may be connected adjacent to the MFP 101. For example, as in the present exemplary embodiment, the MFP 101 may be configured to include the sheet processing unit 122 as standard equipment. Alternatively, the MFP 101 may be configured such that the sheet processing unit 122 is connected as an option.

Cassettes 301*a*, 301*b*, 301*c*, and 301*d* hold sheets. In FIG. 3, the MFP 101 includes four cassettes. However, the number of cassettes is not limited to four. For example, a manual feed tray (not illustrated) and other feed decks that can be connected to the image forming apparatus as an option may be provided. Hereinafter, cassettes, manual feed trays, and feed decks will be referred to as "holding units."

If a holding unit to be used for printing is specified by the user, the CPU 111 feeds a sheet held in the holding unit specified by the user and performs printing. If a holding unit to be used for printing is not specified by the user, the CPU 111 may automatically select from the plurality of holding units a holding unit which feeds a relevant sheet, based on an output size (sheet size) of the print product. Automatically selecting from the plurality of holding units the holding unit to feed the sheet will hereinafter be referred to as auto paper select (APS). In such a case, the CPU 111 can feed a sheet held in the selected holding unit and perform printing.

Feed rollers 303 feed a sheet held in the respective holding units to the printing unit 120. The printing unit 120 prints an image on a first side of the fed sheet. The printing unit 120 may employ an inkjet method in which an image is formed by discharging ink to a sheet. Further, the printing unit 120 may employ an electrophotographic method in which an image is formed by forming an electrostatic latent image on a photosensitive member, developing the electrostatic latent image with toner, transferring the toner image onto a sheet, and then fixing the transferred toner image.

In the case of one-sided printing, the printed sheet is guided by conveyance rollers 305 and 306, conveyed to the sheet processing unit 122, and discharged to an intermediate tray 320. In the case of two-sided printing, after the first side of the sheet is printed by the printing unit 120, the sheet is guided by a conveyance roller 308 and conveyed to a reversing path 310. When a trailing edge of the sheet reaches a conveyance roller 309, the conveyance roller 309 starts to rotate reversely and the sheet is conveyed to the printing unit 120 via a two-sided printing conveyance path 312. The printing unit 120 prints an image on a second side of the sheet. The sheet printed on both sides is guided by the conveyance rollers 305 and 306 and discharged to the intermediate tray 320.

The intermediate tray 320 is inclined with its downstream side in a sheet conveyance direction (left side in the diagram) positioned vertically above and its upstream side (right side in the diagram) vertically below. The intermediate tray 320 can hold a plurality of sheets. The intermediate tray 320 includes a bundle discharge roller pair 318 arranged on the downstream side, and a drawing paddle 315 arranged above a central portion thereof. The bundle discharge roller pair 318 includes a pair of upper and lower bundle discharge rollers 318*a* and 318*b*. The upper bundle discharge roller 318*a* is supported by a guide 317.

The guide 317 is vertically movable by a motor (not illustrated). The upper bundle discharge roller 318*a* arranged on the guide 317 can thus be separated from and brought into contact with the lower bundle discharge roller 318*b* as the guide 317 moves up and down. Consequently, the distance between the upper and lower bundle discharge rollers 318*a* and 318*b* of the bundle discharge roller pair 318 can be adjusted according to the thickness of a sheet bundle held on the intermediate tray 320.

The CPU 111 accepts a sheet P discharged by the conveyance roller 306 onto the intermediate tray 320 with the guide 317 moved up so that the lower bundle discharge roller 318*b* is separated from the upper bundle discharge roller 318*a*.

Alignment members 321 are arranged on the intermediate tray 320 on near and far sides in a width direction orthogonal to the sheet conveyance direction. The alignment member 321 are moved in the width direction by a front alignment motor (not illustrated) and a rear alignment motor (not illustrated), respectively. As employed herein, "near" refers to a portion that comes to the near side of the plane of FIG. 3 when the MFP 101 is viewed in the direction illustrated in FIG. 3. "Far" refers to a portion that comes to the far side of the plane of FIG. 3. The drawing paddle 315 rotates about a rotation shaft in a direction of pressing the sheet P toward a stopper 316 (for example, counterclockwise in FIG. 3).

The sheet P guided by the conveyance roller 306 and discharged to the intermediate tray 320 slides down over a stacking surface of the intermediate tray 320 or a sheet stacked on the intermediate tray 320 owing to the inclination of the intermediate tray 320 and pressing of the sheet P by the drawing paddle 315. The sheet P discharged onto the intermediate tray 320 is subjected to alignment processing by the alignment members 321 while sliding down. The sheet P stops when its trailing edge (upstream end in the discharge direction) abuts on the stopper 316.

The sheet bundle aligned on the intermediate tray 320 is subjected to binding processing by a staple binding unit 314*a* or a stapleless binding unit 314*b* as needed. The staple binding unit 314*a* and the stapleless binding unit 314*b* can bind the sheet bundle held on the intermediate tray 320 at the trailing edge in the conveyance direction. While in the present exemplary embodiment the sheet bundle is bound at the trailing edge in the conveyance direction, exemplary embodiments are not limited thereto. For example, the sheet bundle held on the intermediate tray 320 may be bound at a leading edge in the conveyance direction.

The sheet bundle on which post-processing such as binding processing is performed by the sheet processing unit 122 is discharged to a discharge unit 307. Specifically, the guide 317 is moved to bring the upper bundle discharge roller 318*a* into contact with the topmost sheet on the intermediate tray 320. The bundle discharge roller pair 318 in the contacted state is then driven to rotate, whereby the sheet bundle subjected to the post-processing is discharged onto the discharge unit 307.

Figure 4:
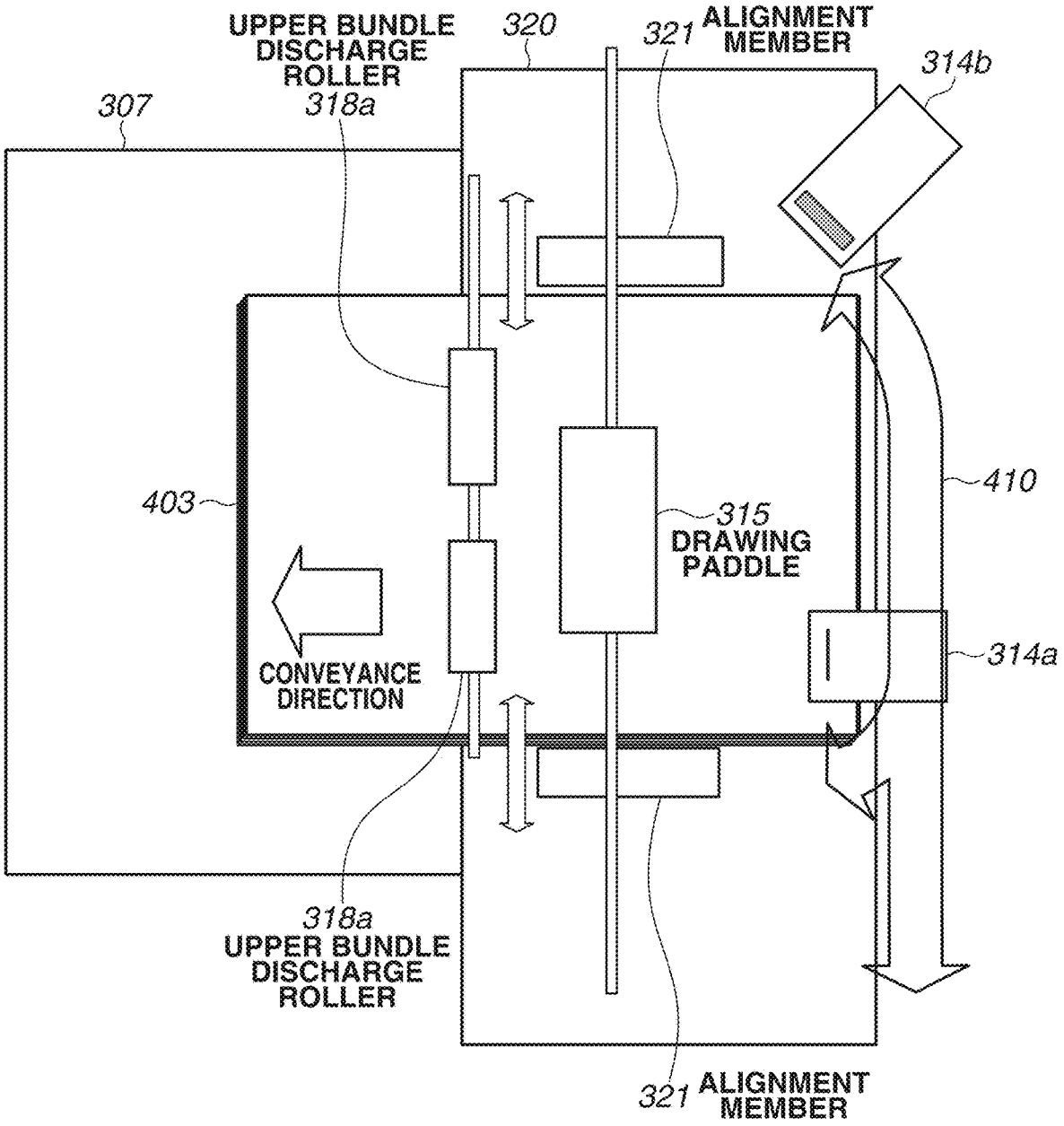
FIG. 4 is a sectional view of a sheet processing unit as seen from above.

FIG. 4 is a sectional view of the sheet processing unit 122 as seen from above. FIG. 4 is a diagram for describing a position where the staple binding unit 314*a* or the stapleless binding unit 314*b* performs binding processing. The sheet processing unit 122 can bind a plurality of sheets 403 according to information about the binding processing received from the control unit 110. The staple binding unit 314*a* is slidable by a not-illustrated motor in a direction indicated by the arrow 410 in the diagram. The CPU 111 drives the not-illustrated motor to move the staple binding unit 314*a* in a direction orthogonal to the conveyance direction to bind the sheet bundle at a corner of the training edge in the conveyance direction or at two locations of the training edge. By the movement of the staple binding unit 314*a* and vertical inversion (180° rotation) of the images to be printed, the sheets can be bound at two locations on a side orthogonal to the conveyance direction. Similarly, the sheets can be bound at any one of the four corners (upper left, upper right, lower right, and lower left).

Further, the staple binding unit 314*a* performs the binding processing by driving in a staple (not illustrated) serving as a binding material for binding the sheet bundle. The staple binding unit 314*a* accommodates a cartridge (not illustrated) which is loaded with staples. The user can replace the cartridge to replenish staples.

The stapleless binding unit 314*b* is fixed to a position on the far side as seen from the front of the MFP 101. To bind a sheet bundle with the stapleless binding unit 314*b*, the following processing is performed. The CPU 111 slides the alignment members 321 to the "far" direction where the stapleless binding unit 314*b* is arranged. The CPU 111 also performs control so that the printed sheet bundle is discharged to the far side of the intermediate tray 320. The stapleless binding unit 314*b* binds the sheet bundle aligned by the alignment member 321 at one location on the far side of the trailing edge. In the present exemplary embodiment, if the stapleless binding unit 314*b* binds the sheet bundle, a rotation of the images to be printed and an order of printing can be combined to perform corner binding at the four corners (upper right, upper left, lower left, and lower right) of the print product.

In the present exemplary embodiment, the stapleless binding unit 314*b* is fixed in the position on the far side. However, exemplary embodiments are not limited thereto. For example, similar to the staple binding unit 314*a*, the stapleless binding unit 314*b* may be moved to bind each corner or two locations of a side of a sheet.

Figure 5A:
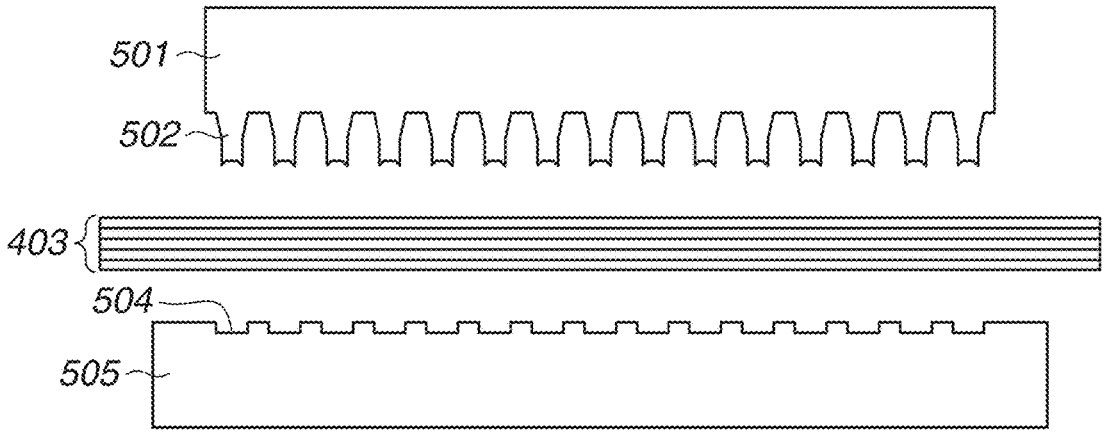
FIGS. 5A and 5B are diagrams for describing binding processing by stapleless binding unit.
Figure 5B:
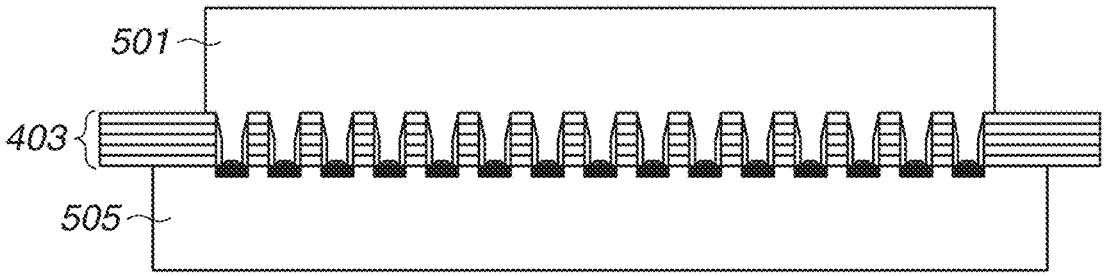

FIGS. 5A and 5B are diagrams illustrating the binging processing by the stapleless binding unit 314*b*. The stapleless binding unit 314*b* according to the present exemplary embodiment applies pressure to a plurality of sheets from above and below, thereby making the sheet bundle 403 stick together to bind the sheets. The stapleless binding unit 314*b* can thus perform the binding processing without using a binding material. FIG. 5A illustrates a state where the stapleless binding unit 314*b* is placed near a position in which to perform the binding processing on the sheet bundle 403. An upper die 501 presses the plurality of sheets from above. The upper die 501 includes a plurality of blades 504 of protruding shape in a row. Each blade 502 applies pressure to the sheets. A lower mold 505 presses the plurality of sheets from below. The lower mold 505 includes a plurality of recesses 504 corresponding to the plurality of blades 502 in a row. The recesses 504 catch the respective blades 502.

FIG. 5B illustrates a state where the upper die 501 and the lower mold 505 vertically press the plurality of sheets. The upper die 501 and the lower mold 505 can press the plurality of sheets to entangle fibers of the sheets to bind them. Since the plurality of blades 502 and the plurality of recesses 504 press the sheets in a plurality of positions, the sheets are less likely to exfoliate.

Figure 6A:
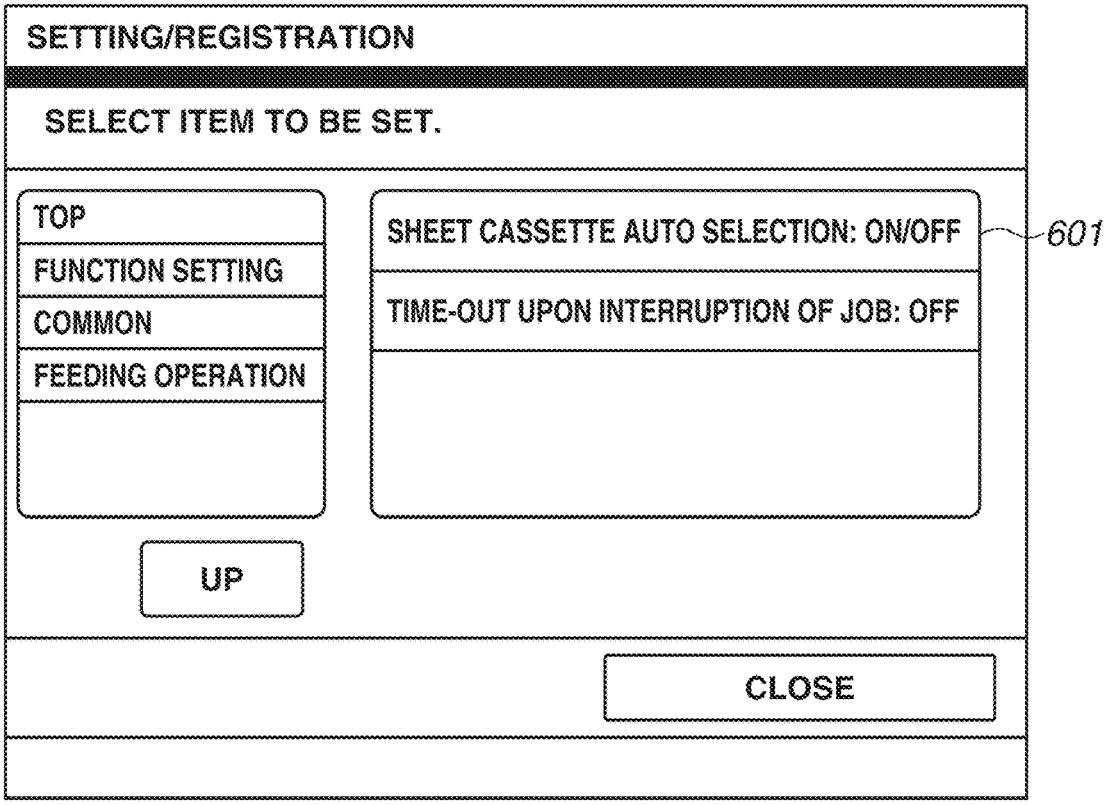
FIGS. 6A and 6B are diagrams illustrating operation screens displayed on a panel.
Figure 6B:
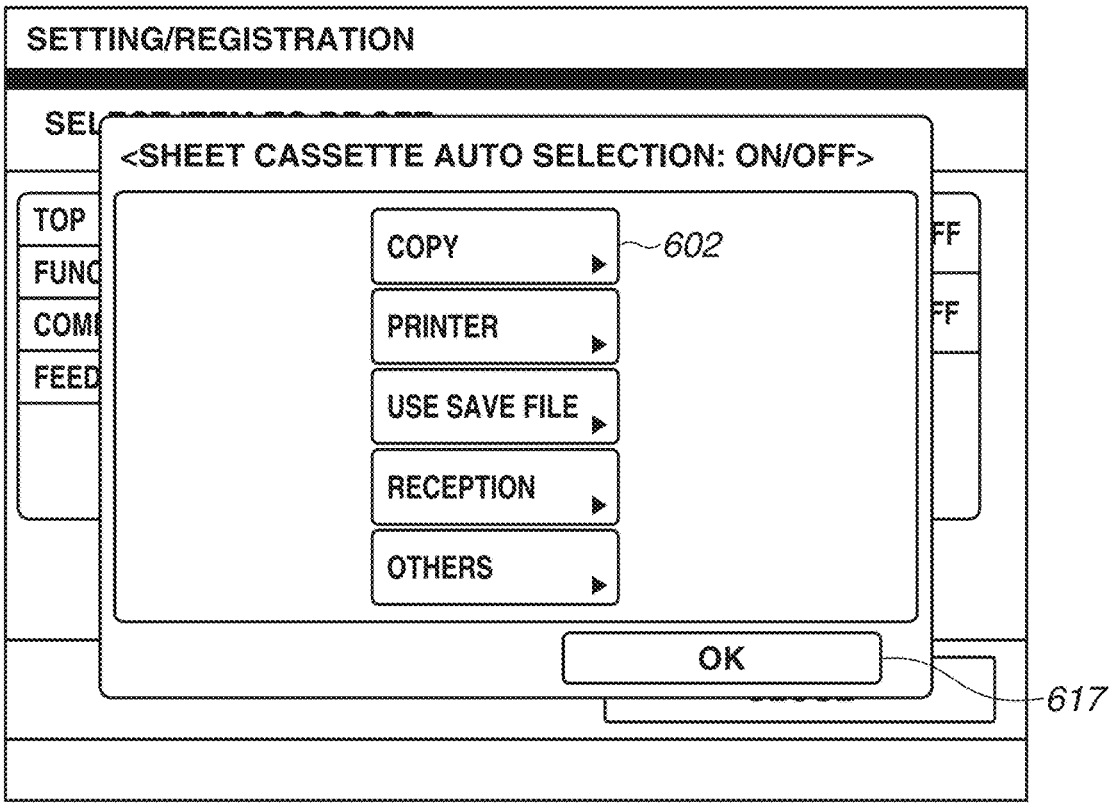
Figure 7:
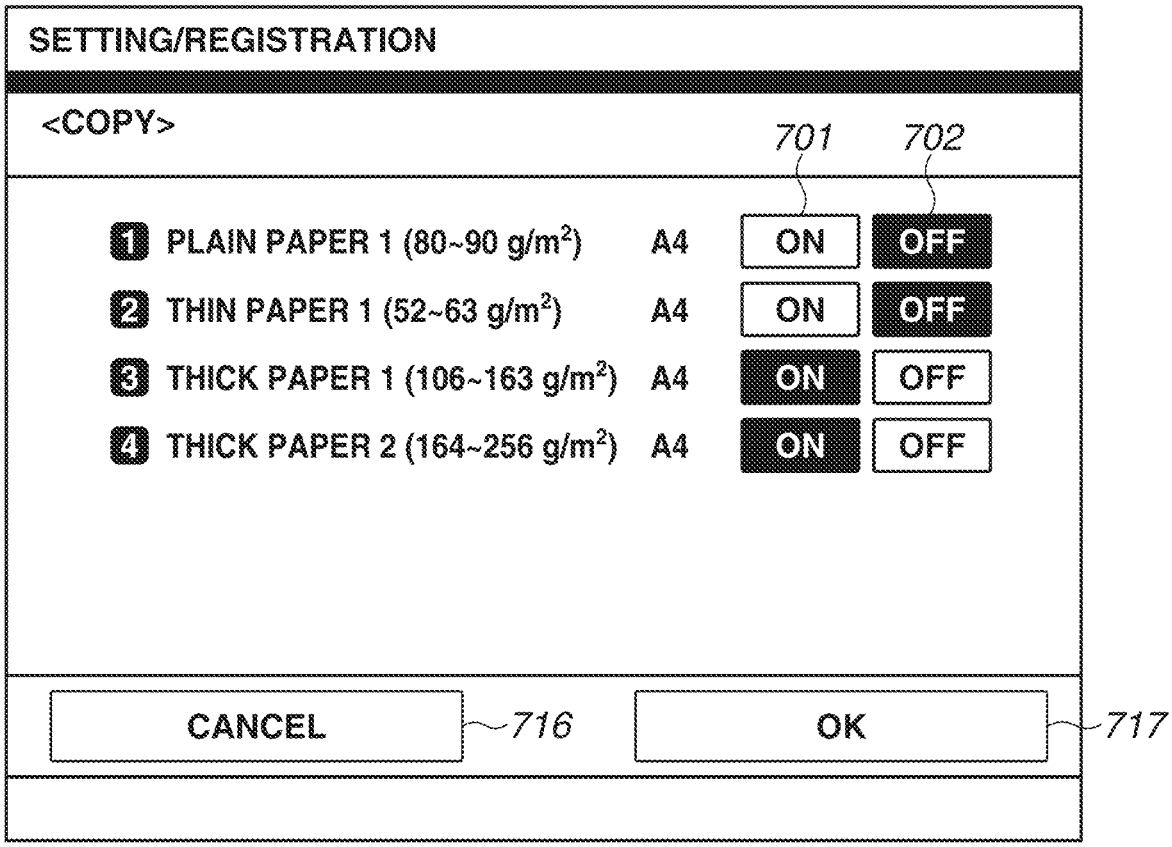
FIG. 7 is a diagram illustrating an operation screen displayed on the panel.

Next, settings related to APS according to the present exemplary embodiment will be described. The user can press the setting button 211 of the operation unit 116 to change settings related to the functions of the MFP 101 and operations of the MFP 101 when various events occur. FIGS. 6A, 6B, and 7 are diagrams illustrating examples of operation screens that the CPU 111 displays on the panel 201 of the operation unit 116.

FIG. 6A illustrates a setting screen related to a sheet feeding operation. The user can select each item illustrated in FIG. 6A and make a setting related to the sheet feeding operation of the MFP 101. A setting key 601 is a key for setting a holding unit to be automatically selected by APS and auto cassette change (ACC). APS is a function for automatically selecting the holding unit to be used when performing print processing based on the output size (sheet side) of the print product. ACC is a function for automatically selecting another holding unit which holds sheets of the same size and continues printing if a holding unit runs out of sheets.

The user can touch the setting key 601 to set the holding unit to be automatically selected. If the setting key 601 is touched, the CPU 111 displays a popup screen for setting the holding unit to be automatically selected. FIG. 6B illustrates the popup screen displayed on the panel 201.

Via the screen of FIG. 6B, the user can set the holding unit to be automatically selected in each of the functions of the MFP 101 including copy processing, print processing based on print data, and facsimile (FAX) reception processing. A copy key 602 is a key for setting the holding unit to be automatically selected in the copy processing. The present exemplary embodiment will hereinafter be described by using the case of the copy processing as an example. An OK key 617 is a key to be used when ending the setting related to the automatic selection and closing the popup screen.

If the copy key 602 is selected, the CPU 111 transitions to a screen for setting the holding unit to be automatically selected in the copy processing. FIG. 7 illustrates a setting screen for setting the holding unit to be automatically selected in the copy processing. FIG. 7 illustrates a case where the third holding unit (cassette 301*c*) and the fourth holding unit (cassette 301*d*) are to be automatically selected. Via the setting screen of FIG. 7, the user can set whether the holding unit is to be automatically selected, for each of the holding units of the MFP 101. Since the MFP 101 according to the present exemplary embodiment includes four holding units as described in FIG. 3, the MFP 101 can select whether the holding unit is to be automatically selected, for each of the four holding units.

ON buttons 701 are keys that are used to determine the holding units to be automatically selected. OFF buttons 702 are keys that are used to determine the holding units to not be automatically selected. The ON buttons 701 and the OFF buttons 702 are intended to make exclusive settings. Either one of buttons 701 and 702 is selected. The CPU 111 accepts the settings in such a way that one or more holding units are set to be automatically selected. Specifically, for example, if all the holding units are set to not be automatically selected (all the holding units are set to an OFF state), the CPU 111 performs control such that the OK key 717 cannot be pressed.

In the present exemplary embodiment, in a case where APS and ACC are performed, the holding unit that is set to be automatically selected via the screens of FIGS. 6A, 6B, and 7 and is holding the sheets of a type intended for APS is automatically selected. Examples of the types of sheets intended for APS include types of sheets that are widely used for printing such as thin paper, plain paper, thick paper having relatively low grammage, recycled paper, and user-defined sheets. This is because when a holding unit which holds sheets of such a type as tab paper and label sheets is set to be automatically selected for printing, the resulting output is likely to be actually different from the user's intention.

FIG. 11 is a diagram illustrating a data model of a sheet information database according to the present exemplary embodiment. The sheet information database stores information about sheets such as grammage and surface properties of the sheets, for reference for each type of sheets usable in the MFP 101. The sheet information data also stores information about whether to apply various settings in the copy processing and print processing, for reference for each type of sheets.

FIG. 11 illustrates a part of the sheet information database. While five types of sheets are illustrated in FIG. 11, the sheet information database manages not-illustrated other sheets as well. The sheet information database also manages information about whether to apply not-illustrated other settings, as needed.

In the present exemplary embodiment, types of sheets intended for APS in the copy processing include plain paper 1, thin paper 1, and thick paper 1 as examples. Types of sheets not intended for APS in the copy processing include thick paper 2 and label paper as examples. Such a sheet information database will also be referred to in the flowcharts to be described below as needed.

In the stapleless binding processing by the stapleless binding unit 314*b*, sheets are crimped for binding. Accordingly, as compared to the staple binding processing by the staple binding processing, the stapleless binding processing is more susceptible to the surface properties and grammage of sheets. The types of sheets capable of the stapleless binding processing are therefore limited as compared to the stale binding processing. For example, as illustrated in an item 1113 of FIG. 11, the stapleless binding processing is limited so that it is not performed on thick papers in view of the binding strength of the sheet bundle.

If a holding unit is automatically selected by APS, a holding unit holding sheets of a type which should not be subjected to the stapleless binding processing (for example, thick paper 1 in FIG. 11) may be automatically selected. In such a case, while the user expects a properly-bound print product, sheets of the type which cannot be bound, can be fed and output without binding processing.

The foregoing issue does not occur if the types of sheets to be automatically selected by APS are limited to only those which can be subjected to the stapleless binding processing (for example, plain paper 1 and thin paper 1). Such a limitation, however, may result in a number of the types of sheets to be processed through APS decreasing when outputting a sheet bundle without binding or when outputting a sheet bundle through the staple binding processing.

In view of such issues, in the present exemplary embodiment, control for selecting a holding unit according to specified binding processing will be described when automatically selecting a holding unit to be used for printing from among a plurality of holding units.

When the user starts to use the MFP 101, a home screen (not illustrated) for selecting processing to be performed is displayed. The user can select a function of the MFP 101 such as a copy function and a transmission function, via the operation unit 116.

Figure 8:
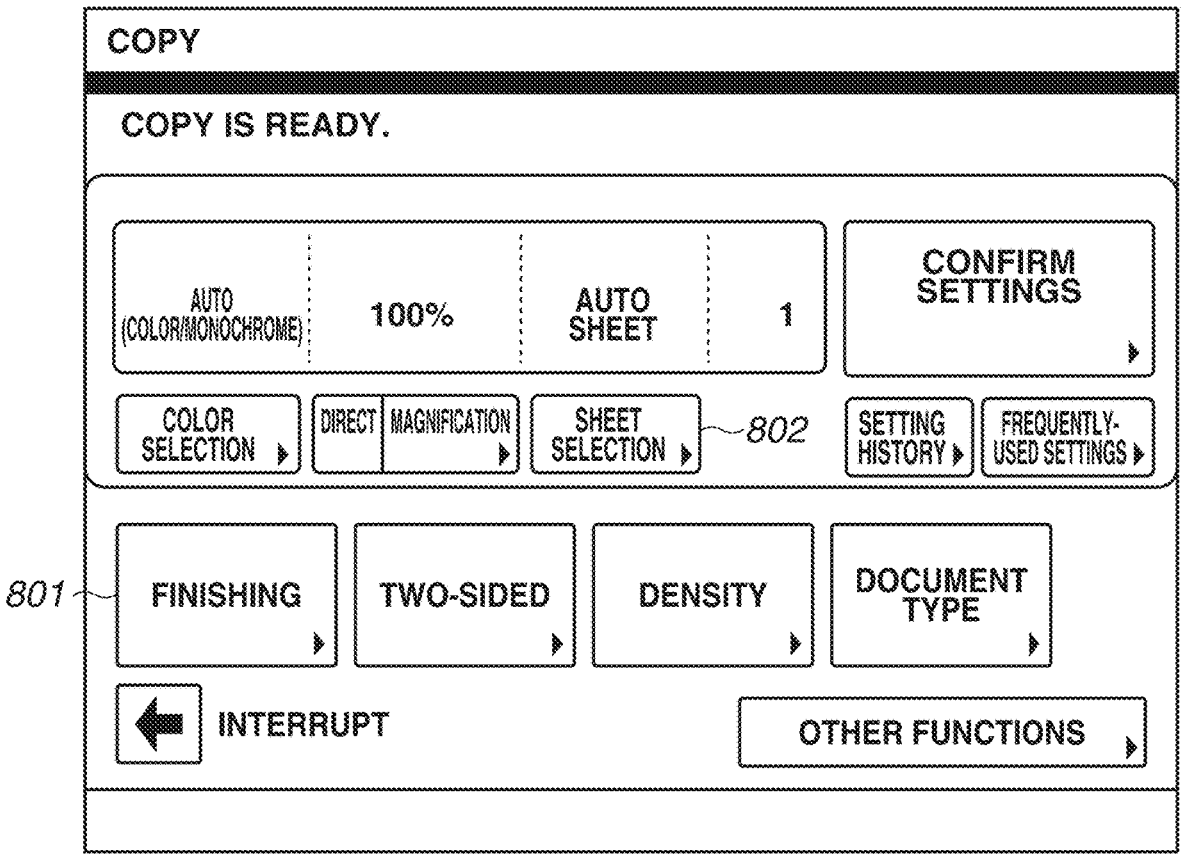
FIG. 8 is a diagram illustrating an operation screen displayed on the panel.

FIG. 8 is a diagram illustrating an example of an operation screen that the CPU 111 displays on the panel 201 of the operation unit 116. If the user selects the copy function via the home screen (not illustrated), the CPU 111 displays a setting screen of a copy job illustrated in FIG. 8 on the panel 201.

With respect to settings of a copy job, there are a number of setting items. It is difficult to make all the settings within an identical screen. Therefore, to make settings about a plurality of functions, the screen thus transitions to individual setting screens for each setting item.

Figure 9A:
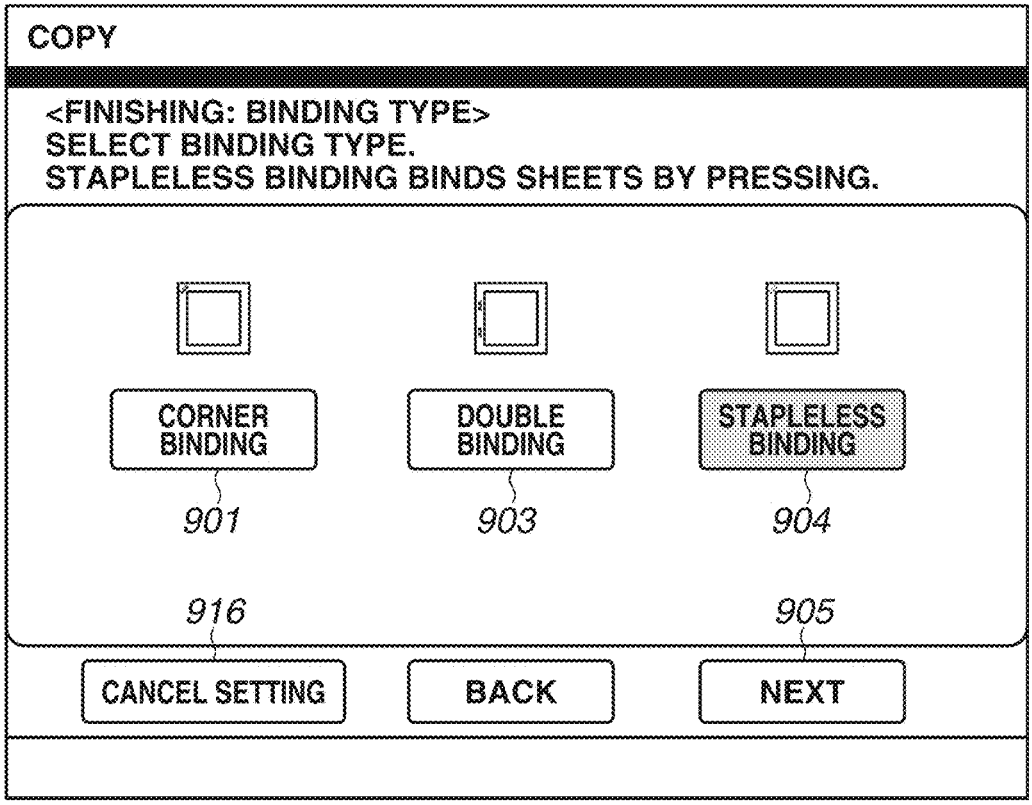
FIGS. 9A and 9B are diagrams illustrating operation screens displayed on the panel.
Figure 9B:
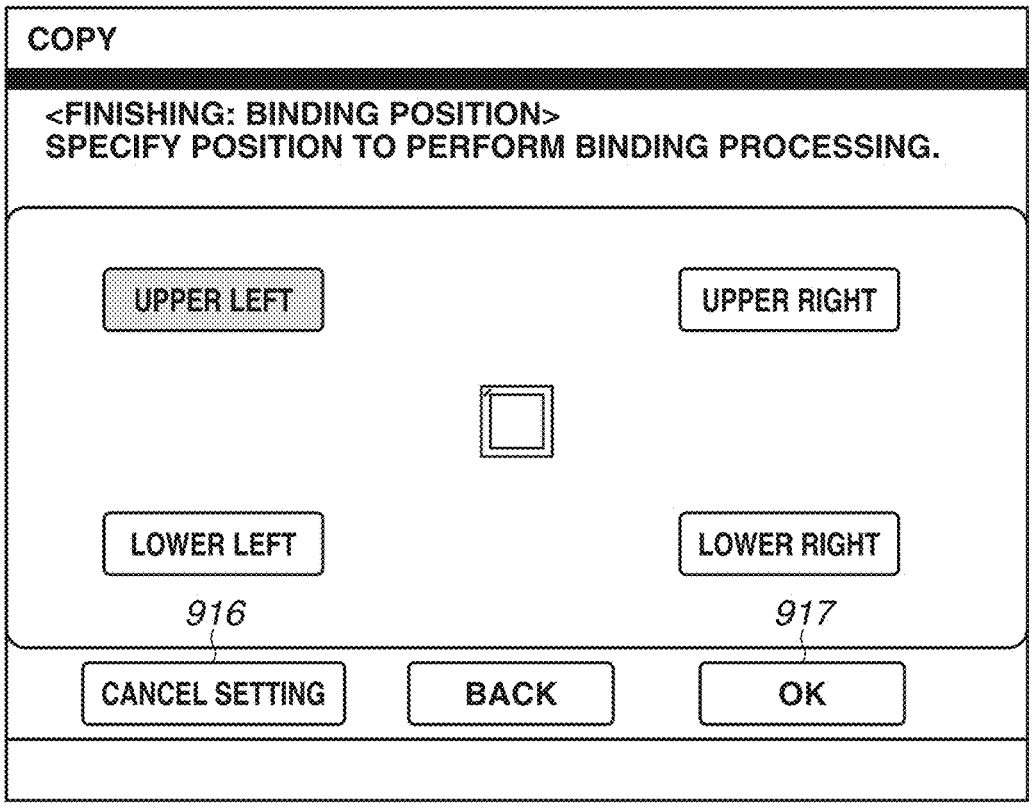

A finishing key 801 is a key to be used when setting finishing processing for the copy processing. FIGS. 9A and 9B are diagrams illustrating examples of a setting screen related to the finishing processing. If the finishing key 801 is touched, the CPU 111 displays a screen for setting the finishing processing. FIG. 9A illustrates an example of the screen for setting the finishing processing. FIG. 9A illustrates a state where a stapleless binding key 904 is selected. Keys 901, 903, and 904 are exclusively set and any one of the keys 901, 903, and 904 can be selected. If none of the keys 901, 903, and 904 is selected, the CPU 111 makes a setting which outputs a sheet without the finishing processing.

The finishing processing refers to general post processing performed on a print product to be output. In the present exemplary embodiment, post processing related to binding processing are described, however, exemplary embodiments are not limited thereto. Settings of other post processing (such as a group sort and a shift sort) may be included in the processing.

A corner binding key 901 is a key to be used when performing binding processing on any one of the four corners (upper right, upper left, lower left, and lower right) of the print product by using a staple. A double binding key 903 is a key to be used when performing binding processing in two locations of any one side of the print product by using staples. The stapleless binding key 904 is a key to be used when performing binding processing on any one of the four corners (upper right, upper left, lower left, and lower right) of the print product without using a staple.

A next key 905 is a key to be used when making detailed settings of the selected finishing processing. If the next key 905 is touched, the CPU 111 transitions to a detailed setting screen of the finishing processing. A cancel setting key 916 is a key to be used when discarding the settings made about the finishing processing via the screens of FIGS. 9A and 9B. If the cancel setting key 916 is touched, the CPU 111 discards the settings about the finishing processing and transitions to the setting screen of the copy function (FIG. 8).

If the next key 905 is touched selecting the corner binding key 901 or the stapleless binding key 904, the CPU 111 sets a binding position via a screen for selecting any one of the four corners as illustrated in FIG. 9B.

FIG. 9B is a diagram illustrating an example of the detailed setting screen of the finishing processing to be displayed if the next key 905 is touched selecting the corner binding key 901 or the stapleless binding key 904. FIG. 9B illustrates a state where the upper left corner is selected. The user specifies a binding position via the screen of FIG. 9B. The keys corresponding to the upper left, upper right, lower right, and lower left are exclusively set. Any one of the keys can be selected.

An OK key 917 is a key to be used when applying the setting of the finishing processing selected via the screens of FIGS. 9A and 9B. If the OK key 917 is touched, the CPU 111 applies the setting made about the finishing processing via the screens of FIGS. 9A and 9B as copy settings, and returns to the setting screen of the copy function (FIG. 8).

In the present exemplary embodiment, the settings of the finishing processing are made via the separate screens illustrated in FIGS. 9A and 9B. However, the exemplary embodiment is not limited thereto. Any screens may be used as long as the type of the binding processing and the binding position(s) can be specified. For example, the type of the binding processing and the binding position(s) may be specified within a single screen. Alternatively, a selection window of the binding position(s) may be displayed in a popup manner.

Figure 10A:
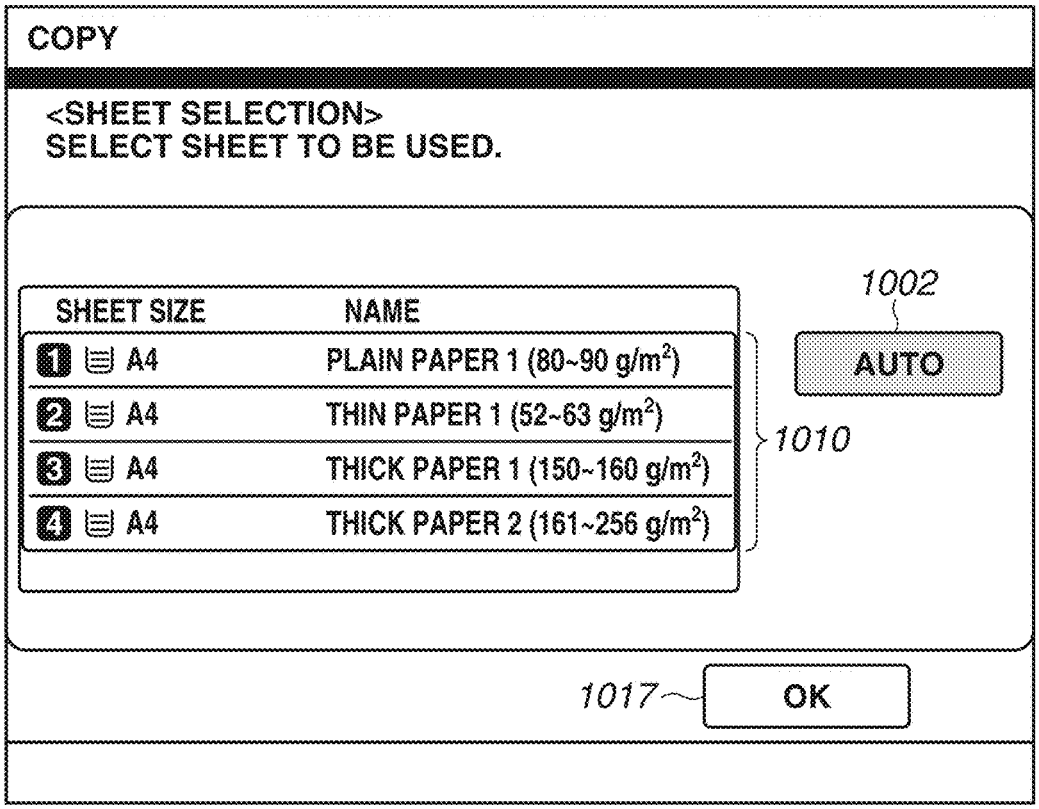
FIGS. 10A and 10B are diagrams illustrating an operation screen displayed on the panel.
Figure 10B:
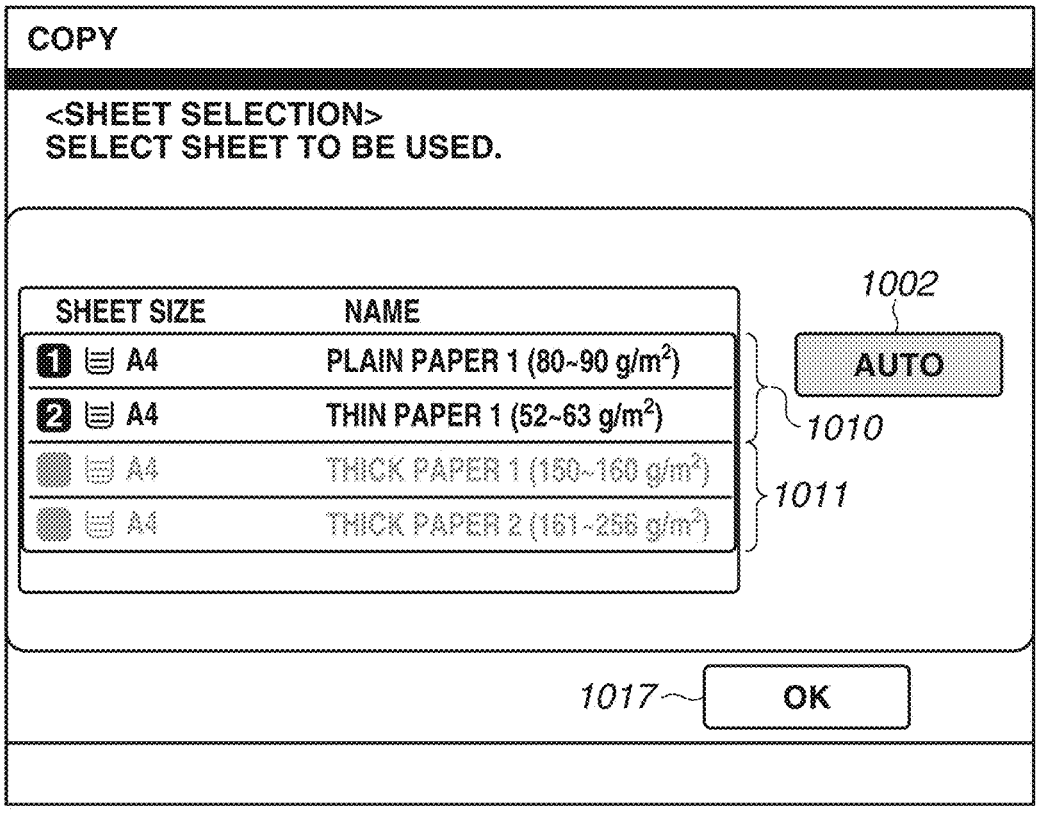

Return to the description of FIG. 8. A sheet selection key 802 is a key to be used when selecting a holding unit to be used for printing. If the sheet selection key 802 is touched, the CPU 111 displays a screen for selecting a holding unit to be used for printing. FIGS. 10A and 10B are diagrams illustrating examples of an operation screen that the CPU 111 displays on the panel 201 of the operation unit 116.

FIG. 10A illustrates a screen for selecting a holding unit to be used for printing. FIG. 10A illustrates an example of the screen displayed if the staple binding processing is specified as a finishing setting or if no binding processing is specified as a finishing setting.

The user can specify a holding unit to be used for printing via the screen of FIG. 10A. An area 1010 shows holding units selectable by the user. The user can touch each row to specify a holding unit to be used for printing. For example, as illustrated by items 1111 and 1112, the same staple binding processing can be performed on plain paper 1, thin paper 1, thick paper 1, and thick paper 2. All the holding units are therefore selectable.

On the other hand, FIG. 10B illustrates a screen for selecting a sheet to be used for printing and an example of the screen displayed if the stapleless binding processing is specified as a finishing setting. The area 1010 shows holding units displayed as selectable by the user. An area 1011 shows holding units not selectable by the user. The user touches a row displayed as selectable to specify a holding unit to be used for printing. For example, as illustrated in the item 1113 of FIG. 11, the stapleless binding processing can be performed on plain paper 1 and thin paper 1 but not on thick paper 1 or thick paper 2. If the stapleless binding processing is specified, the CPU 111 therefore displays the holding units holding the sheets which cannot be subjected to the stapleless binding processing, as not selectable.

Specifically, when the CPU 111 displays the screens of FIGS. 10A and 10B, the CPU 111 obtains the types of the sheets held in the holding units and refers to the sheet information database (FIG. 11) based on the obtained types of the sheets. The CPU 111 compares various settings made via the setting screen of the copy function with the sheet information database and determines whether to display the holding units as selectable or not selectable.

An auto key 1002 is a key to be selected when automatically selecting a holding unit in APS. In the present exemplary embodiment, the automatic selection of a holding unit in APS is set as default of the copy function. More specifically, if the user does not specify a holding unit, a holding unit is automatically selected based on settings made in advance via the screens of FIGS. 6A, 6B, and 7.

An OK key 1017 is a key to be used when applying the setting of the holding unit (sheet) to be used for printing, made via the screen. If the OK key 1017 is touched, the CPU 111 applies the setting made about the holding unit via the screen of FIG. 10A or 10B, and returns to the setting screen of the copy function (FIG. 8).

Figure 13:
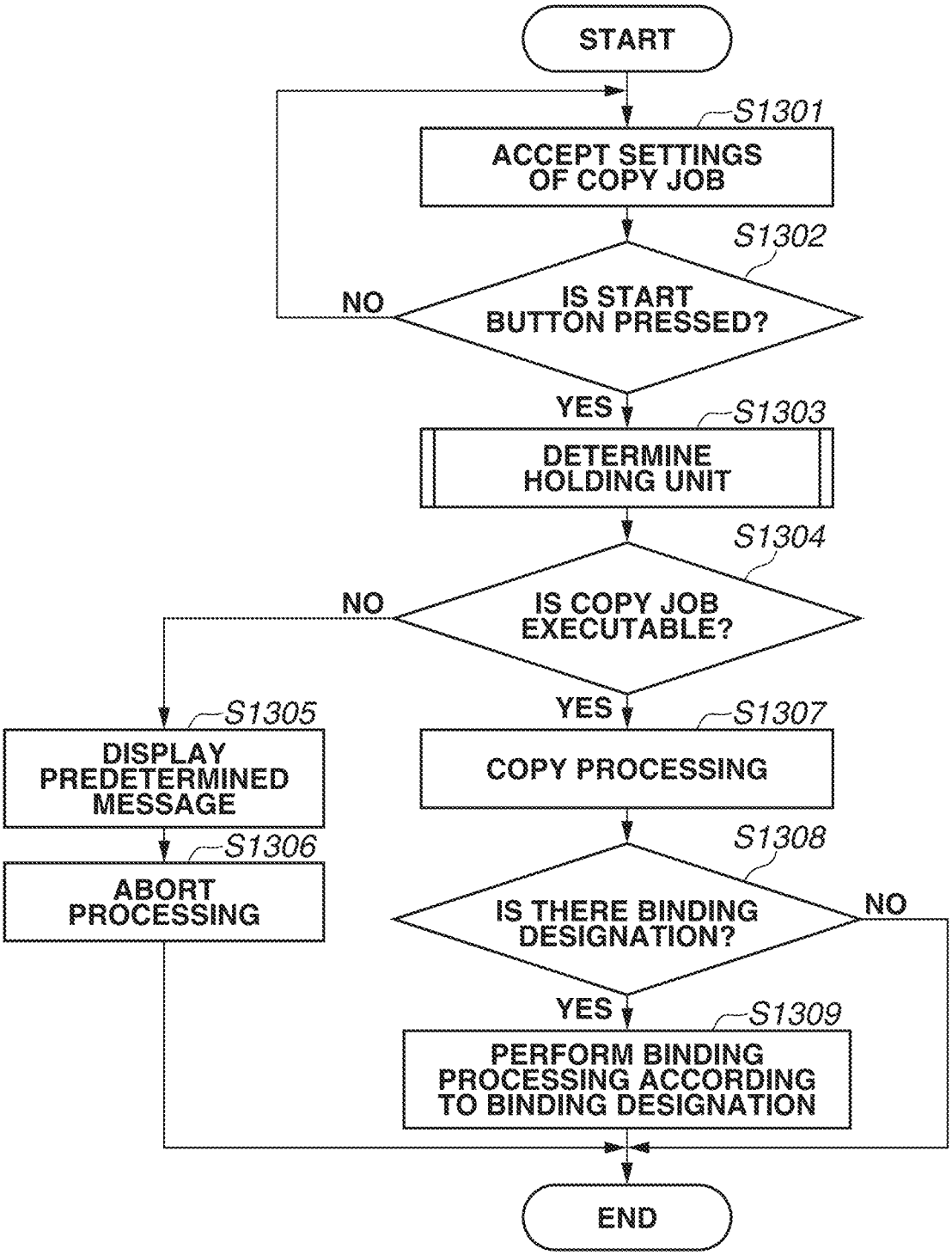
FIG. 13 is a flowchart for describing a control method of print processing.
Figure 14:
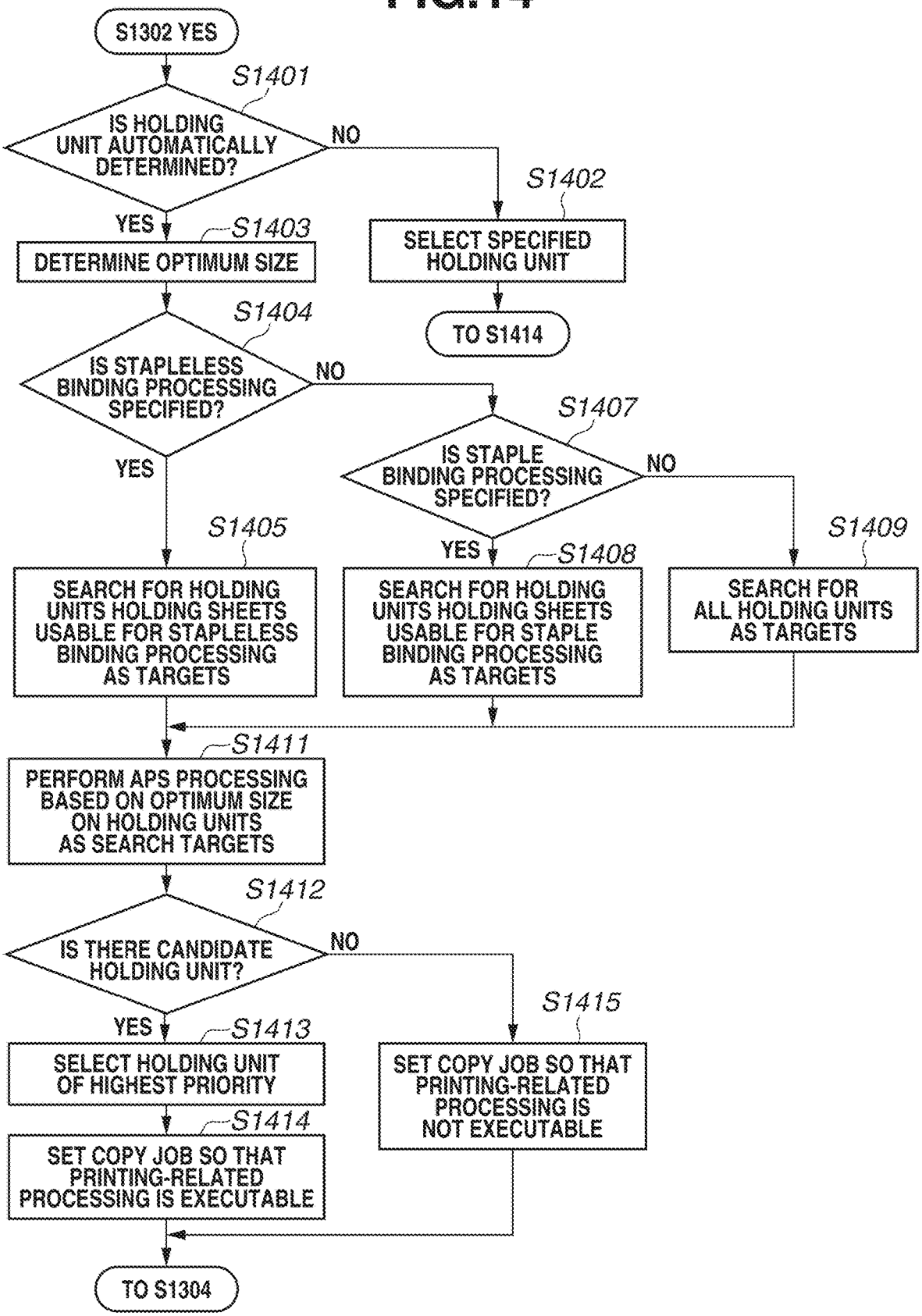
FIG. 14 is a flowchart for describing the control method of the print processing.

Next, control of the copy processing according to the present exemplary embodiment will be described. FIGS. 13 and 14 are flowcharts illustrating the control of the copy processing. The operations (steps) of the flowcharts illustrated in FIGS. 13 and 14 are implemented by the CPU 111 reading a control program stored in the ROM 112 or the storage 114 into the RAM 113 and executing the control program. If the user selects the copy function via the home screen (not illustrated), the CPU 111 performs the control corresponding to the flowcharts of FIGS. 13 and 14.

In step S1301, the CPU 111 accepts settings of a copy job via the panel 201. As the settings of the copy job, the CPU 111 accepts the foregoing settings related to binding processing and designation of a holding unit to be used for printing related to sheets for printing. The CPU 111 also accepts other different settings according to the user's instructions, including a setting of the number of copies to be printed and a setting of magnification.

In step S1302, the CPU 111 determines whether the start button 212 is pressed. If the start button 212 is pressed (YES in step S1302), the processing proceeds to step S1303. If the start button 212 is not pressed (NO in step S1302), the processing returns to step S1301. In step S1301, the CPU 111 accepts the settings of the copy job via the panel 201.

In step S1303, the CPU 111 determines a holding unit to be used for printing. Details will be described with reference to FIG. 14. In step S1401, the CPU 111 determines whether there is a setting that automatically determines a holding unit. If there is a setting that automatically determines a holding unit through APS as a setting of the copy job (YES in step S1401), the processing proceeds to step S1403. On the other hand, if a holding unit to be used for printing is specified as a setting of the copy job (NO in step S1401), the processing proceeds to step S1402. In step S1402, the CPU 111 selects the holding unit specified as a setting of the copy job. The processing proceeds to step S1414.

In step S1403, the CPU 111 determines the size of a sheet that is optimum when copying a print product based on the settings of the copy job and the size of a document set on the reading unit 118. In step S1404, the CPU 111 determines whether the stapleless binding processing is specified as a setting of the copy job. If the stapleless binding processing is specified (YES in step S1404), the processing proceeds to step S1405. If the stapleless binding processing is not specified (NO in step S1404), the processing proceeds to step S1407.

In step S1405, the CPU 111 obtains the types of the sheets held in the holding units set to be automatically selected. In the example of automatic selection illustrated in FIG. 7, thick paper 1 held in the third holding unit and thick paper 2 held in the fourth holding unit are obtained.

The CPU 111 then refers to the sheet information database based on the obtained types of the sheets, and determines whether the sheets can be subjected to the stapleless binding processing. If a sheet held in a holding unit is of a type usable for the stapleless binding processing, the CPU 111 searches for the holding unit which holds the relevant sheet, as a target of APS processing described below. In the example of automatic selection illustrated in FIG. 7, thick papers 1 and 2 are sheets of types not usable for binding by the stapleless binding processing. There is therefore no holding unit as a search target for the APS processing.

In step S1407, the CPU 111 determines whether the staple binding processing is specified as a setting of the copy job. If the staple binding processing is specified (YES in step S1407), the processing proceeds to step S1408. If the staple binding processing is not specified (NO in step S1407), the processing proceeds to step S1409. In step S1408, the CPU 111 obtains the types of the sheets held in the holding units set as automatically selected. Based on the obtained types of the sheets, the CPU 111 then determines whether the sheets are capable of the staple binding processing. If a sheet held in a holding unit is of a type usable for the staple binding processing, the CPU 111 searches for the holding unit holding the relevant sheet, as a target for the APS processing described below. In the example of automatic selection illustrated in FIG. 7, thick papers 1 and 2 are sheets of types usable for binding by the staple binding processing. The third and fourth holding units are thus the search targets for the APS processing.

In step S1409, the CPU 111 searches for all the holding units set to be automatically selected as targets of the APS processing. In the example of automatic selection illustrated in FIG. 7, the third and fourth holding units are the search targets of the APS processing.

In step S1411, the CPU 111 performs the APS processing based on the optimum size, on the holding units as the search targets. In the APS processing, if a holding unit as a search target holds a sheet of the same size as the optimum size calculated in step S1403 and the sheet is to be automatically selected, the CPU 111 takes the holding unit as a candidate for the holding unit to be used for printing. If there is a plurality of candidate holding units, the CPU 111 prioritizes the holding units based on time needed for feeding and the amounts of sheets held in the cassettes. The APS processing described here is just an example, and may be modified as appropriate. For example, a holding unit of a size close to the optimum size may be included as a candidate to be used for printing.

In step S1412, the CPU 111 determines whether a candidate for the holding unit to be used for printing has been found in step S1411. If a candidate for the holding unit has been found (YES in step S1412), the processing proceeds to step S1413. If no candidate for the holding unit has been found (NO in step S1412), the processing proceeds to step S1415. In step S1413, the CPU 111 selects the holding unit of the highest priority as the holding unit to be used for printing. The processing proceeds to step S1414. In step S1414, the CPU 111 sets the copy job such that printing-related processing is executable. The processing returns to step S1304.

In step S1415, the CPU 111 sets the copy job such that printing-related processing is not executable. The processing returns to step S1304.

Return to the description of FIG. 13. In step S1304, the CPU 111 determines whether the copy job is executable. If the copy job is set such that printing-related processing is executable (YES in step S1304), the processing proceeds to step S1307. On the other hand, if the copy job is set such that printing-related processing is not executable (NO in step S1304), the processing proceeds to step S1305.

Figure 12:
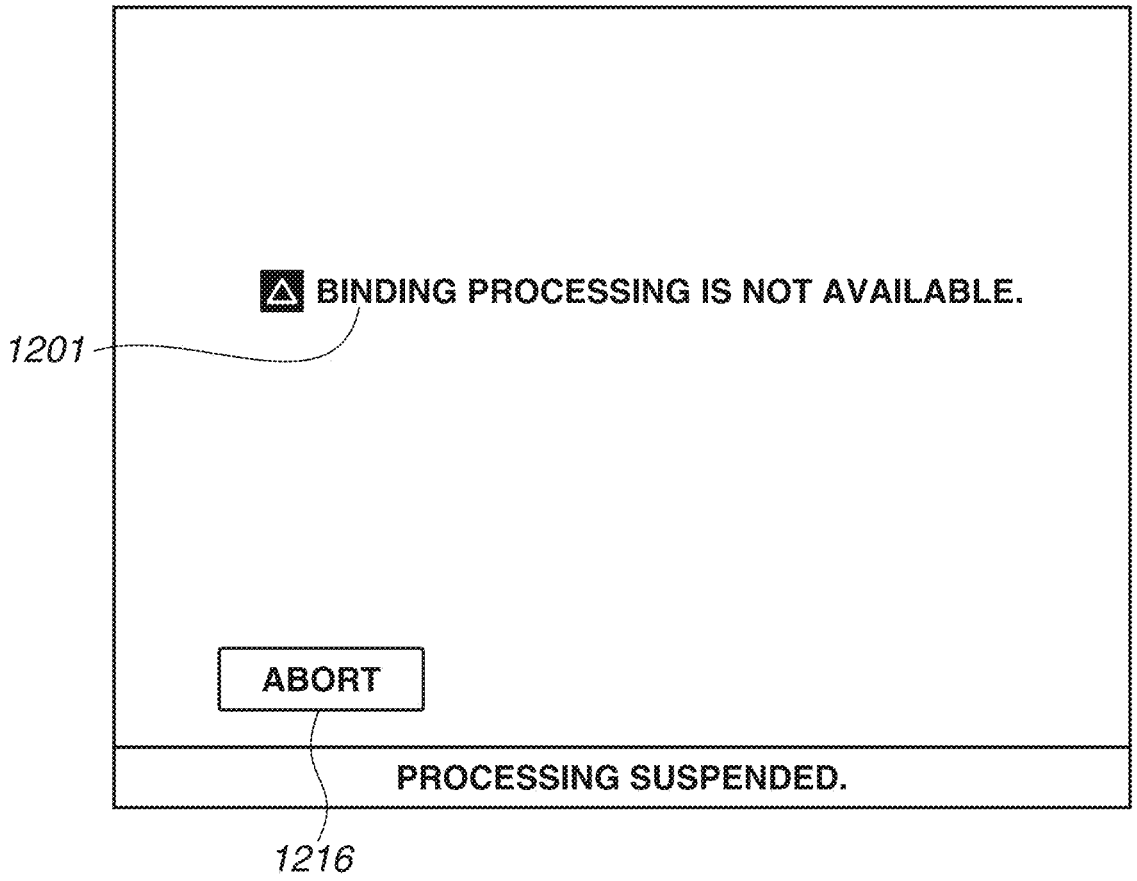
FIG. 12 is a diagram illustrating an operation screen displayed on the panel.

In step S1305, the CPU 111 displays a predetermined message on the panel 201. FIG. 12 illustrates an example of the screen displayed on the panel 201. Information 1201 is information for notifying the user that the binding processing cannot be performed. An abort key 1216 is a key to be used when closing the predetermined message.

Return to the description of FIG. 13. In step S1306, if the CPU 111 determines that the abort key 1216 is touched, the CPU 111 aborts the copy job to avoid performing print processing. Then, the processing ends. If the abort key 1216 is pressed, the processing may return to step S1301. In such a case, the display "COPY IS READY" in FIG. 9A may be changed to a display such as "SETTING(S) NEED TO BE CHANGED."

On the other hand, in step S1307, the CPU 111 controls the reading unit 118 and the printing unit 120 to perform the copy processing based on the settings of the copy job. If binding processing is specified in the copy job, the CPU 111 rotates and prints the image read by the reading unit 118 as appropriate according to the binding position.

In step S1308, the CPU 111 determines whether the settings of the copy job include designation of binding processing. If there is any binding designation (YES in step S1308), the processing proceeds to step S1309. If there is no binding processing (NO in step S1309), the CPU 111 discharges the sheet bundle to the discharge unit 307. Then, the processing ends. In step S1309, the CPU 111 controls the sheet processing unit 122 to perform the binding processing according to the binding designation. The CPU 111 then discharges the sheet bundle on which the binding processing has been performed to the discharge unit 307. Then, the processing ends.

In the present exemplary embodiment, the CPU 111 makes the determination of step S1303 after the determination of step S1302. However, exemplary embodiments are not limited thereto. For example, the CPU 111 may perform the processing of step S1303 when it is detected that a document has been set on the reading unit 118 and/or each time a change of the settings of the copy job is accepted in step S1301.

As described above, in the present exemplary embodiment, when automatically selecting a holding unit, the holding unit holding sheets which can be bound through the binding processing specified by the job can be a search target of APS. Therefore, when performing print processing by automatically selecting a holding unit, sheets which cannot be bound, are prevented from being fed from the holding unit.

In the first exemplary embodiment, control is performed such that a holding unit holding sheets which can be bound in the binding processing specified by a job becomes a search target of APS. In a second exemplary embodiment, control is performed such that after APS is performed on a holding unit set to be automatically selected, a holding unit holding sheets which cannot be bound in the binding processing specified by a job is not selected.

Figure 15:
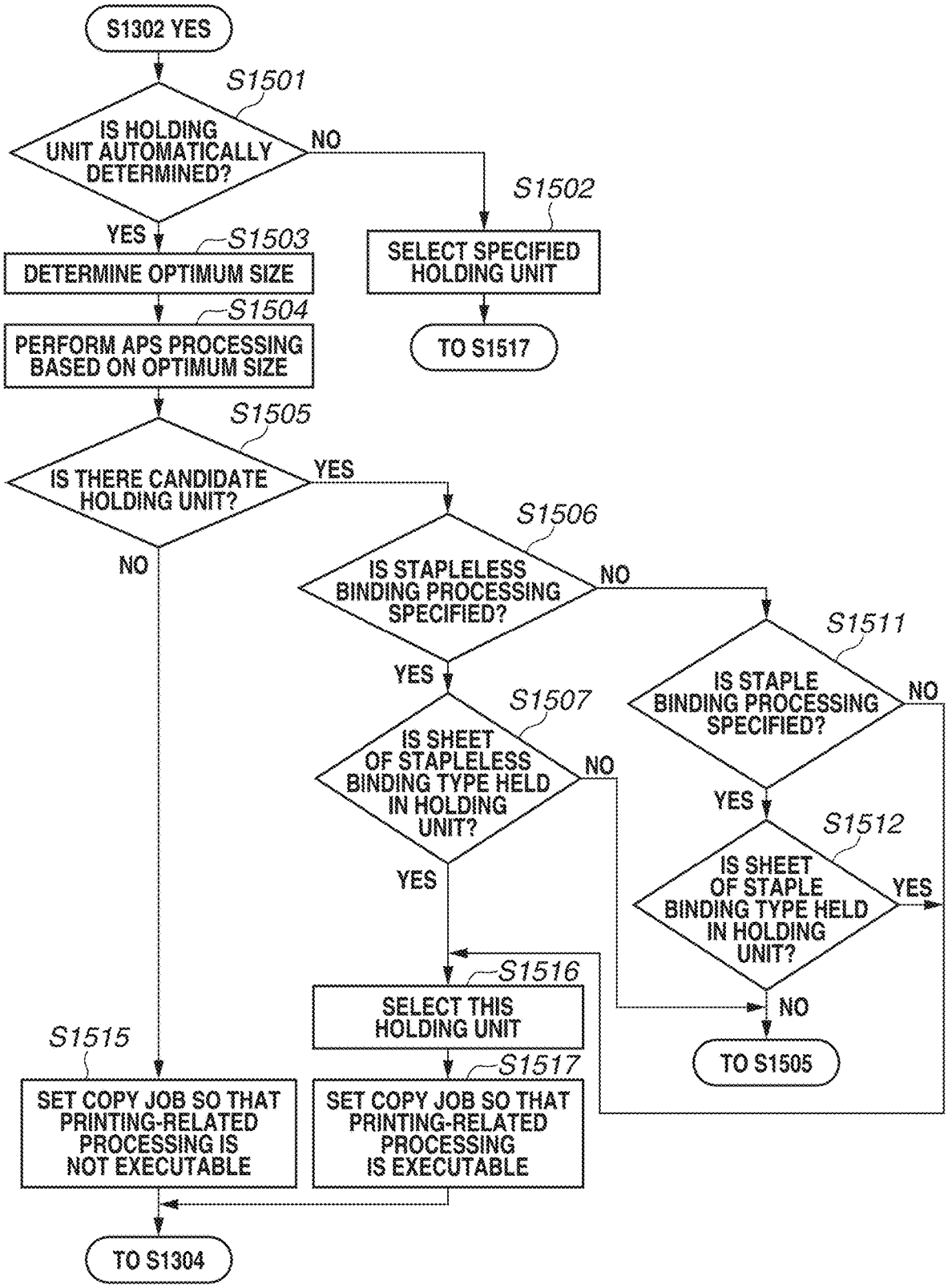
FIG. 15 is a flowchart for describing a control method of print processing.

The hardware configuration of an intended apparatus according to the second exemplary embodiment is similar to that of the first exemplary embodiment. A detailed description of configurations similar to the first exemplary embodiment will be omitted. In the second exemplary embodiment, the flowchart illustrated in FIG. 15 is performed instead of the flowchart of FIG. 14 described in the first exemplary embodiment. The operations (steps) of the flowchart illustrated in FIG. 15 are implemented by the CPU 111 reading a control program stored in the ROM 112 or the storage 114 into the RAM 113 and executing the control program.

If the user selects the copy function via the home screen (not illustrated), the CPU 111 performs the flowchart of FIG. 13.

In step S1301, the CPU 111 accepts settings of the copy job via the panel 201. In step S1302, if the start button 212 is pressed (YES in step S1302), the processing proceeds to step S1303. If the start button 212 is not pressed (NO in step S1302), the processing returns to step S1301. In step S1303, the CPU 111 determines that a holding unit is used for printing. Details will be described with reference to the flowchart of FIG. 15.

Steps S1501 to S1503 are similar to steps S1401 to S1403 according to the first exemplary embodiment. A description thereof will thus be omitted.

In step S1504, the CPU 111 performs the APS processing based on the optimum size on the holding unit set to be automatically selected. In the APS processing, a candidate for the holding unit to be used for printing is selected in a manner similar to step S1411 according to the first exemplary embodiment.

In step S1505, the CPU 111 determines whether there is a candidate for the holding unit to be used for printing. If there is a candidate holding unit (YES in step S1505), the processing proceeds to step S1506. If there is no candidate holding unit (NO in step S1505), the processing proceeds to step S1515. In step S1515, the CPU 111 sets the copy job such that printing-related processing is not executable. The processing returns to step S1304.

On the other hand, in step S1506, the CPU 111 determines whether the stapleless binding processing is specified as a setting of the copy job. If the stapleless binding processing is specified (YES in step S1506), the processing proceeds to step S1507. If the stapleless binding processing is not specified (NO in step S1506), the processing proceeds to step S1511. In step S1507, the CPU 111 obtains the type of the sheet held in the holding unit of the highest priority among the candidate holding units. Next, the CPU 111 refers to the sheet information database based on the obtained type of the sheet, and determines whether the sheet can be subjected to the stapleless binding processing. If the sheet held in the holding unit is of a type which can be subjected to the stapleless binding processing (YES in step S1507), the processing proceeds to step S1516. On the other hand, if the sheet held in the holding unit is not of a type which can be subjected to the stapleless binding processing (NO in step S1507), the CPU 111 excludes the holding unit from the candidates for the holding unit and the processing returns to step S1505.

In step S1516, the CPU 111 selects this holding unit as the holding unit to be used for printing and the processing proceeds to step S1517. In step S1517, the CPU 111 sets the copy job such that printing-related processing is executable and the processing returns to step S1304.

On the other hand, in step S1511, the CPU 111 determines whether the staple binding processing is specified as a setting of the copy job. If the staple binding processing is specified (YES in step S1511), the processing proceeds to step S1512. On the other hand, if the staple binding processing is not specified (NO in step S1511), the processing proceeds to step S1516. In step S1516, the CPU 111 selects this holding unit as the holding unit to be used for printing.

In step S1512, the CPU 111 obtains the type of the sheet held in the holding unit of the highest priority, from among the candidate holding units. Next, the CPU 111 refers to the sheet information database based on the obtained type of the sheet, and determines whether the sheet is capable of the staple binding processing. If the sheet held in the holding unit is of a type which can be subjected to the staple binding processing (YES in step S1512), the processing proceeds to step S1516. If the sheet held in the holding unit is not of a type which can be subjected to the staple binding processing (NO in step S1512), the CPU 111 excludes this holding unit from the candidates for the holding unit and the processing returns to step S1505.

The processing of step S1304 and subsequent steps is similar to that of the first exemplary embodiment. A description thereof will thus be omitted.

As described above, in the second exemplary embodiment, control is performed such that after a holding unit is automatically selected, a holding unit holding sheets which cannot be bound through the binding processing specified by the job is prevented from being selected. When performing print processing by automatically selecting a holding unit, sheets which cannot be bound, are prevented from being fed from the holding unit.

<Other Exemplary Embodiments>

The first and second exemplary embodiments have dealt with an example of control for automatically selecting a holding unit in the copy processing of the MFP 101. However, an exemplary embodiment of an aspect of the present invention may be applied to control for automatically selecting a holding unit in other functions. For example, an exemplary embodiment of an aspect of the present invention may be applied to print processing for receiving print data from an information processing apparatus such as the PC 102 and performing print processing. Further, an exemplary embodiment can be applied to print control when printing a saved file stored in the storage 114, and reception processing for receiving a FAX or mail and performing print processing.

If the exemplary embodiment of an aspect of the present invention is applied to the print processing, the CPU 111 may perform control for determining a holding unit in step S1303 and subsequent steps of FIG. 13 based on print attribute information (print settings) obtained by analyzing the print data. The PC 102 may transmit print data specifying the type of sheets via a printer driver, and may transmit print data without specifying the type of sheets. In steps S1411 and S1504, if the type of sheets is specified as a print setting, the CPU 111 then performs control to search for holding units which holds the sheets specified as the print setting, as candidates for the holding unit. On the other hand, if the type of sheets is not specified as a print setting, the CPU 111 performs control to search for candidates for the holding unit based on a type of sheets intended for APS in the print processing, previously stored in the MFP 101.

If the exemplary embodiment of an aspect of the present invention is applied to the reception processing, the CPU 111 may perform control for determining a holding unit in step S1303 and subsequent steps based on the print settings made at the time of the reception processing.

Other Embodiments

Embodiments of aspects of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to an exemplary embodiment of an aspect of the present invention, when selecting a holding unit to be used from among a plurality of holding units which holds sheets, based on a sheet size, an appropriate selection is performed according to specified binding processing.

While aspects of the present invention have been described with reference to exemplary embodiments, it is to be understood that the aspects of the invention are not limited to the disclosed exemplary embodiments. The scope of the following claims is to be accorded the broadest interpretation so as to encompass all such modifications and equivalent structures and functions.

What is claimed is:

1. An image forming apparatus comprising:

a plurality of sheet feeding trays;

an image forming unit configured to form an image on a sheet fed from the sheet feeding trays;

a first binding unit configured to perform a first binding processing for binding a plurality of sheets, on which an image is formed by the image forming unit, with using a staple;

a second binding unit configured to perform a second binding processing for binding a plurality of sheets, on which an image is formed by the image forming unit, without using a staple; and a control unit configured to obtain (i) information indicating a sheet feeding source which is a sheet feeding tray selected from the plurality of sheet feeding trays, (ii) information indicating a binding type which is one of the first binding processing and the second binding processing, and (iii) information indicating a sheet type of sheets in the selected sheet feeding tray and control the image forming unit to form an image on a sheet fed from the feeding source and control a plurality of binding units among the first binding unit and the second binding unit to perform a binding processing corresponding to the binding type, wherein in a case where the binding type corresponds to the first binding processing and the sheet type corresponds to a first sheet type of sheets performable with both the first binding processing and the second binding processing, the control unit allows an image forming process on a sheet fed from the feeding source, in a case where the binding type corresponds to the first binding processing and the sheet type corresponds to a second sheet type of sheets performable with the first binding processing but not performable with the second binding processing, the control unit allows an image forming process on sheets fed from the feeding source, in a case where the binding type corresponds to the second binding processing and the sheet type corresponds to the first sheet type of sheets, the control unit allows an image forming process on sheets fed from the feeding source, and in a case where the binding type corresponds to the second binding processing and the sheet type corresponds to the second sheet type of sheets, the control unit inhibits an image forming process on a sheet fed from the feeding source.

2. The image forming apparatus according to claim 1, wherein the first type of sheet is smaller in basis weight than the second type of sheet.

3. The image forming apparatus according to claim 1, wherein the first type of sheet is a thin paper.

4. The image forming apparatus according to claim 1, wherein the first type of sheet is a plain paper.

5. The image forming apparatus according to claim 1, wherein the second type of sheet is a thick paper.

6. The image forming apparatus according to claim 1, wherein the second type of sheet is a label sheet.

7. The image forming apparatus according to claim 1, wherein in a case where the binding type corresponds to the second binding processing and the sheet type corresponds to the second sheet type of sheets, the control unit displays a predetermined message on a display unit before starting to form an image.

8. The image forming apparatus according to claim 1, further comprising:

an operation unit configured to receive, from a user, the information indicating the binding type.

9. The image forming apparatus according to claim 1, wherein the second binding unit is configured to bind a plurality of sheets, without using a staple, by applying pressure on the plurality of sheets at a binding position.

10. The image forming apparatus according to claim 1, wherein the sheet feeding trays are sheet cassettes.

11. The image forming apparatus according to claim 1, wherein the sheet feeding source is automatically selected from the plurality of sheet feeding trays.

12. An image forming apparatus connectable with a sheet processing unit configured to perform a first binding processing for binding a plurality of sheets with using a staple and a second binding processing for binding a plurality of sheets without using a staple, the image forming apparatus comprising:

a plurality of sheet feeding trays;

an image forming unit configured to form an image on a sheet fed from the sheet feeding trays; and a control unit configured to obtain (i) information indicating a sheet feeding source which is a sheet feeding tray selected from the plurality of sheet feeding trays, (ii) information indicating a binding type which is one of the first binding processing and the second binding processing, and (iii) information indicating a sheet type of sheets in the selected sheet feeding tray and control the image forming unit to form an image on a sheet fed from the feeding source and control the sheet processing unit such that a binding processing corresponding to the binding type is performed, wherein in a case where the binding type corresponds to the first binding processing and the sheet type corresponds to a first sheet type of sheets performable with both the first binding processing and the second binding processing, the control unit allows an image forming process on a sheet fed from the feeding source, in a case where the binding type corresponds to the first binding processing and the sheet type corresponds to a second sheet type of sheets performable with the first binding processing but not performable with the second binding processing, the control unit allows an image forming process on sheets fed from the feeding source, in a case where the binding type corresponds to the second binding processing and the sheet type corresponds to the first sheet type of sheets, the control unit allows an image forming process on sheets fed from the feeding source, and in a case where the binding type corresponds to the second binding processing and the sheet type corresponds to the second sheet type of sheets, the control unit inhibits an image forming process on a sheet fed from the feeding source.

13. The image forming apparatus according to claim 12, wherein the first type of sheet is smaller in basis weight than the second type of sheet.

14. The image forming apparatus according to claim 12, wherein the first type of sheet is a thin paper.

15. The image forming apparatus according to claim 12, wherein the first type of sheet is a plain paper.

16. The image forming apparatus according to claim 12, wherein the second type of sheet is a thick paper.

17. The image forming apparatus according to claim 12, wherein the second type of sheet is a label sheet.

18. The image forming apparatus according to claim 12, wherein in a case where the binding type corresponds to the second binding processing and the sheet type corresponds to the second sheet type of sheets, the control unit displays a predetermined message on a display unit before starting to form an image.

19. The image forming apparatus according to claim 12, further comprising:

an operation unit configured to receive, from a user, the information indicating the binding type.

20. The image forming apparatus according to claim 12, wherein the second binding unit is configured to bind a plurality of sheets, without using a staple, by applying pressure on the plurality of sheets at a binding position.

21. The image forming apparatus according to claim 12, wherein the sheet feeding trays are sheet cassettes.

22. The image forming apparatus according to claim 12, wherein the sheet feeding source is automatically selected from the plurality of sheet feeding trays.

* * * * *